US006537116B2

(12) United States Patent
Nakata et al.

(10) Patent No.: US 6,537,116 B2
(45) Date of Patent: Mar. 25, 2003

(54) COOLING SYSTEM FOR OUTBOARD MOTOR

(75) Inventors: Jun Nakata, Hamamatsu (JP); Yasuhiko Shibata, Hamamatsu (JP)

(73) Assignee: Sanshin Kogyo Kabushiki Kaisha, Hamamatsu (JP)

( * ) Notice: Subject to any disclaimer, the term of this patent is extended or adjusted under 35 U.S.C. 154(b) by 0 days.

(21) Appl. No.: 09/860,852

(22) Filed: May 18, 2001

(65) Prior Publication Data

US 2002/0002019 A1 Jan. 3, 2002

(30) Foreign Application Priority Data

May 18, 2000 (JP) ..... 2000-145987
May 18, 2000 (JP) ..... 2000-145988

(51) Int. Cl.[7] ..... B63H 21/38
(52) U.S. Cl. ..... 440/88; 440/89
(58) Field of Search ..... 440/88, 89

(56) References Cited

U.S. PATENT DOCUMENTS 3,310,022 A * 3/1967 Kollman ..... 440/75
3,350,879 A * 11/1967 Boda et al. ..... 440/89
4,421,490 A * 12/1983 Nakahama ..... 440/88
4,604,069 A 8/1986 Taguchi
4,607,723 A 8/1986 Okazaki
5,036,804 A 8/1991 Shibata
5,149,284 A 9/1992 Kawai
5,232,387 A 8/1993 Sumigawa
5,326,295 A 7/1994 Nakayama
5,487,688 A 1/1996 Sumigawa
5,733,157 A 3/1998 Okuzawa et al.
5,769,038 A 6/1998 Takahashi et al.
5,823,835 A 10/1998 Takahashi et al.
5,950,425 A 9/1999 Takahashi et al.
6,053,784 A 4/2000 Takahashi

OTHER PUBLICATIONS

Co–pending patent application: Serial No. 09/303,066, filed Apr. 30, 1999, entitled Exhaust Arrangement for Outboard Motor, in the names of Hiroyuki Tsunekawa, Takehide Watanabe, and assigned to Sanshin Kogyo Kabushiki Kaisha.

* cited by examiner

*Primary Examiner*—Sherman Basinger
(74) *Attorney, Agent, or Firm*—Knobbe, Martens, Olson & Bear, LLP

(57) ABSTRACT

A cooling system for an outboard motor includes an improved construction that can inhibit a housing unit of the outboard motor from absorbing heat that causes discoloring of the unit. The outboard motor includes a power head that has an engine. The housing unit depends from the power head. An exhaust conduit is arranged to discharge exhaust gases from the engine. At least a portion of the exhaust conduit extends through the housing unit. A cooling system is arranged to cool at least the portion of the exhaust conduit by coolant. The cooling system includes an inner coolant pool surrounding the portion of the exhaust conduit and an outer coolant pool surrounding the inner coolant pool. The cooling system supplies the coolant to the inner and outer pools. The coolant supplied to the outer pool is cooler than the coolant supplied to the inner pool.

39 Claims, 15 Drawing Sheets

COOLING SYSTEM FOR OUTBOARD MOTOR

PRIORITY INFORMATION

This application is based on and claims priority to Japanese Patent Applications No. 2000-145987, filed May 18, 2000, No. 2000-145988, filed May 18, 2000, the entire contents of which are hereby expressly incorporated by reference.

BACKGROUND OF THE INVENTION

1. Field of the Invention

This invention relates generally to a cooling system for an outboard motor, and more particularly to an improved cooling system for an exhaust system of an outboard motor.

2. Description of Related Art

An outboard motor typically comprises a power head including an internal combustion engine and a housing unit depending from the power head. The outboard motor, because of its compact nature, generally employs an exhaust system that includes an exhaust conduit in the housing unit and that exhausts through a submerged discharge port.

The conventional outboard motor also employs an open-loop cooling system that draws cooling water from the body of water in which the outboard motor is operated (e.g., a lake or an ocean) to primarily cool engine portions. The cooling water also is introduced into the exhaust system in order to cool the exhaust gases and the exhaust system through which the exhaust gases pass. The exhaust system then returns the cooling water to the body of water.

Usually, a majority of the cooling water that has run through cooling jackets within the engine is also used for cooling the exhaust system. This water has an increased temperature because the engine is extraordinary heated during operation. This heated water can come into contact with an inner surface of the housing unit such that heat is transferred to the housing unit. When the outboard motor is used in soft water environments, water containing a calcium (Ca) component contacts an outer surface of the housing unit. The calcium (Ca) component, when the housing unit is heated, discolors the housing unit to white. The discolored housing unit can deteriorate appearance of the outboard motor.

A need therefore exists for an improved cooling system for an outboard motor that can reduce heat transfer to a housing unit such that discoloring of the housing unit can be reduced.

When the outboard motor is used on the sea and sea water is employed for cooling the exhaust system, another problem can occur. The problem is that the exhaust gases produce sulfuric acid with the sea water that causes sulfuric acid corrosion of the housing unit.

Another need thus exists for an improved cooling system for an outboard motor that can inhibit a housing unit from causing sulfuric acid corrosion.

SUMMARY OF THE INVENTION

In accordance with one aspect of the present invention, an outboard motor comprises a power head including an internal combustion engine. A housing unit depends from the power head. An exhaust conduit is arranged to discharge exhaust gases from the engine. At least a portion of the exhaust conduit extends through the housing unit. A cooling system is arranged to cool at least the portion of the exhaust conduit by coolant. The cooling system includes an inner coolant pool surrounding the portion of the exhaust conduit. An outer coolant pool surrounds the inner coolant pool. The cooling system supplies the coolant to the inner and outer pools. The coolant supplied to the outer pool is cooler than the coolant supplied to the inner pool.

In accordance with another aspect of the present invention, an outboard motor comprises a power head including a four-cycle, internal combustion engine. A housing unit depends from the power head. A lubricant tank for the engine is disposed in the housing unit. An exhaust conduit is arranged to discharge exhaust gases from the engine. The exhaust conduit is disposed through the lubricant tank and at least a portion of the exhaust conduit extends lower than a bottom of the lubricant tank. A cooling system is arranged to cool at least the lubricant tank and the exhaust conduit by coolant. The cooling system includes an inner coolant pool surrounding the portion of the exhaust conduit. An outer coolant pool surrounds the inner coolant pool and the lubricant tank. The cooling system supplies the coolant to the inner and outer pools.

In accordance with a further aspect of the present invention, an outboard motor comprises a power head including an internal combustion engine. A housing unit depends from the power head. An exhaust system is arranged to discharge exhaust gases from the engine. The exhaust system includes an exhaust pipe connected to the engine and an expansion chamber disposed downstream of the exhaust pipe. The housing unit includes a tubular section to define a coolant pool that surrounds a portion of the exhaust pipe. The tubular section has a portion defining a bottom of the coolant pool. The portion of the tubular section is disposed in proximity to a top end of the expansion chamber.

In accordance with a still further aspect of the present invention, an outboard motor comprises a power head including an internal combustion engine. A housing unit depends from the power head. An exhaust system is arranged to discharge exhaust gases from the engine. The exhaust system includes an exhaust conduit having an outlet arranged to open to a space within the housing unit. The housing unit includes a portion forming a water pool surrounding the exhaust pipe. The housing unit defines a water discharge pathway through which the water in the water pool is discharged. The housing unit further defines a dividing wall separating the water discharge pathway from the space.

BRIEF DESCRIPTION OF THE DRAWINGS

These and other features, aspects and advantages of the present invention will now be described with reference to the drawings of a preferred embodiment, which is intended to illustrate and not to limit the invention. The drawings comprise 21 figures.

DETAILED DESCRIPTION OF THE PREFERRED EMBODIMENTS OF THE INVENTION

Figure 1:
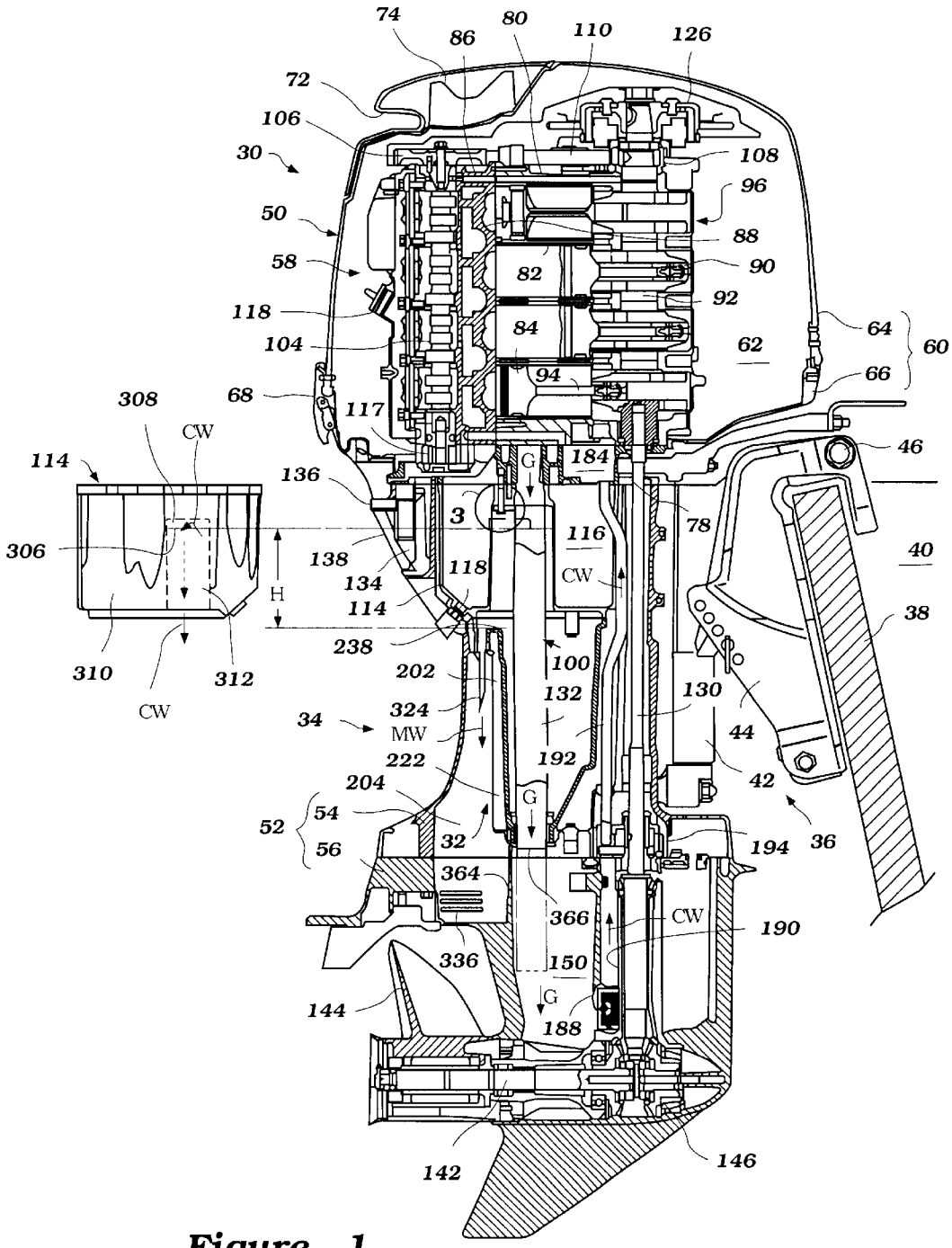
FIG 1 is a side elevational, sectional view of an outboard motor configured in accordance with a preferred embodiment of the present invention. This figure includes a side view of a lubricant tank on the port side to compare respective heights of spillways.
Figure 2:
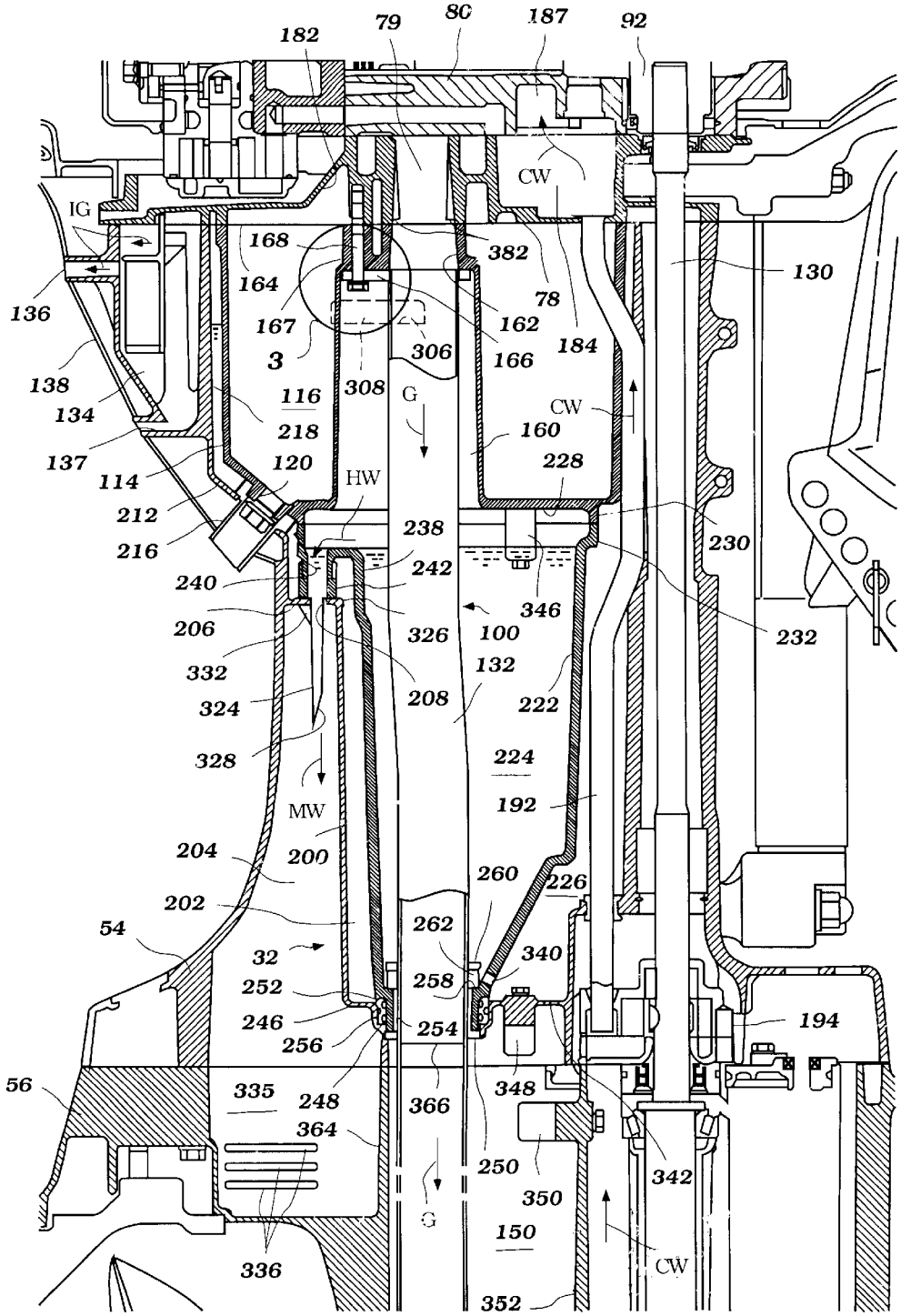
FIG. 2 is an enlarged side sectional view of the outboard motor to show a driveshaft housing in particular.

With reference to FIGS. 1 and 2, an overall construction of an outboard motor 30, which employs a cooling system 32 arranged in accordance with certain features, aspects and advantages of the present invention will be described.

In the illustrated arrangement, the outboard motor 30 comprises a drive unit 34 and a bracket assembly 36. The bracket assembly 36 supports the drive unit 34 on a transom 38 of an associated watercraft 40 and places a marine propulsion device in a submerged position with the watercraft 40 resting on the surface of a body of water. The bracket assembly 36 preferably comprises a swivel bracket 42, a clamping bracket 44, a steering shaft and a pivot pin 46.

The steering shaft typically extends through the swivel bracket 42 and is affixed to the drive unit 34. The steering shaft is pivotally journaled for steering movement about a generally vertically extending steering axis defined within the swivel bracket 42. The clamping bracket 44 comprises a pair of bracket arms that are spaced apart from each other and that are affixed to the watercraft transom 38. The pivot pin 46 completes a hinge coupling between the swivel bracket 42 and the clamping bracket 44. The pivot pin 46 extends through the bracket arms so that the clamping bracket 44 supports the swivel bracket 42 for pivotal movement about a generally horizontally extending tilt axis defined by the pivot pin 46. The drive unit 34 thus can be tilted or trimmed about the pivot pin 46.

As used through this description, the terms "forward," "forwardly" and "front" mean at or to the side where the bracket assembly 36 is located, and the terms "rear," "reverse," "backwardly" and "rearwardly" mean at or to the opposite side of the front side, unless indicated otherwise or otherwise readily apparent from the context use.

A hydraulic tilt and trim adjustment system preferably is provided between the swivel bracket 42 and the clamping bracket 44 to tilt (raise or lower) the swivel bracket 42 and the drive unit 34 relative to the clamping bracket 44. Otherwise, the outboard motor 30 can have a manually operated system for tilting the drive unit 34. Typically, the term "tilt movement", when used in a broad sense, comprises both a tilt movement and a trim adjustment movement.

The illustrated drive unit 34 comprises a power head 50 and a housing unit 52 which includes a driveshaft housing 54 and a lower unit 56. The power head 50 is disposed atop the drive unit 34 and houses an internal combustion engine 58 that is positioned within a protective cowling 60. Preferably, the protective cowling 60 defines a generally closed cavity 62 in which the engine 58 is disposed. In addition, the protective cowling 60 preferably comprises a top cowling member 64 and a bottom cowling member 66. The top cowling member 64 preferably is detachably affixed to the bottom cowling 66 by a coupling mechanism 68 so that a user, operator, mechanic or repair person can access the engine 58 for maintenance or for other purposes.

The top cowling 64 preferably has at least one air intake opening 72 and at least one air duct 74 disposed on its rear and top portion. Ambient air is drawn into the closed cavity 62 through the opening 72 and then through the duct 74. Typically, the top cowling member 64 tapers in girth toward its top surface, which is in the general proximity of the air intake opening 72.

The bottom cowling member 66 preferably has an opening at its bottom portion through which an upper portion of an exhaust guide member or intermediate member 78 extends. The exhaust guide member 78 preferably is made of an aluminum based alloy and is affixed atop the driveshaft housing 54. The bottom cowling member 66 and the exhaust guide member 78 together generally form a tray. The engine 58 is placed onto this tray and is affixed to the exhaust guide member 78. The exhaust guide member 78 also has an exhaust passage 79 through which burnt charges (e.g., exhaust gases) from the engine 58 are discharged as described below.

The engine 58 in the illustrated embodiment operates on a four-cycle combustion principle. The engine 58 has a cylinder block 80. The presently preferred cylinder block 80 defines four cylinder bores 82 which extend generally horizontally and are generally vertically spaced from one another. As used in this description, the term "horizontally" means that the subject portions, members or components extend generally in parallel to the water line where the associated watercraft is resting when the drive unit 34 is not tilted and is placed in the position shown in FIG. 1. The term "vertically" in turn means that portions, members or components extend generally normal to those that extend horizontally. This type of engine, however, merely exemplifies one type of engine on which various aspects and features of the present invention can be suitably used. Engines having other numbers of cylinders, having other cylinder arrangements, and operating on other combustion principles (e.g., crankcase compression two-stroke or rotary) also can employ various features, aspects and advantages of the present invention.

A piston 84 reciprocates in each cylinder bore 82 in a well-known manner. A cylinder head assembly 86 is affixed to one end of the cylinder block 80 for closing the cylinder bores 82. The cylinder head assembly 86 preferably defines four combustion chambers 88 together with the associated pistons 84 and cylinder bores 82. Of course, the number of combustion chambers can vary, as indicated above. A crankcase assembly 90 closes the other end of the cylinder bores 82 and defines a crankcase chamber together with the cylinder block 80. A crankshaft 92 extends generally vertically through the crankcase chamber and is journaled for rotation by several bearing blocks in a suitable arrangement. Connecting rods 94 couple the crankshaft 92 in a well-known manner with the respective pistons 84. Thus, the crankshaft 92 can rotate with the reciprocal movement of the pistons 84.

Preferably, the crankcase assembly 90 is located at the most forward position, with the cylinder block 80 and the cylinder head member 86 extending rearward from the crankcase assembly 90, one after another. Generally, the cylinder block 80, the cylinder head member 86 and the crankcase assembly 90 together define an engine body 96. Preferably, at least these major engine portions 80, 86, 90 are made of aluminum based alloy. The aluminum alloy advantageously increases strength over cast iron while decreasing the weight of the engine body 96.

The engine 58 comprises an air induction system. The air induction system draws air to the combustion chambers from the cavity 62 of the protective cowling assembly 60. The air induction system preferably comprises intake ports, four intake passages and a plenum chamber. The intake ports can be defined in the cylinder head assembly 86. In one configuration, intake valves repeatedly open and close the respective intake ports. When each intake port is opened, the corresponding intake passage communicates with the associated combustion chamber 88. The respective intake passages preferably have throttle valves journaled therein for pivotal movement about an axis of a valve shaft that extends generally vertically. The throttle valves are operable by the operator through an appropriate conventional throttle valve linkage. The throttle valves measure or regulate an amount of air flowing through the respective air intake passages. Normally, the greater the opening degree, the higher the rate of airflow and the higher the engine speed.

The engine 54 also comprises an exhaust system 100 that routes burnt charges or exhaust gases to a location outside of the outboard motor 30. Each cylinder bore 82 preferably has exhaust ports defined in the cylinder head assembly 86. The exhaust ports are repeatedly opened and closed by exhaust valves.

Figure 10:
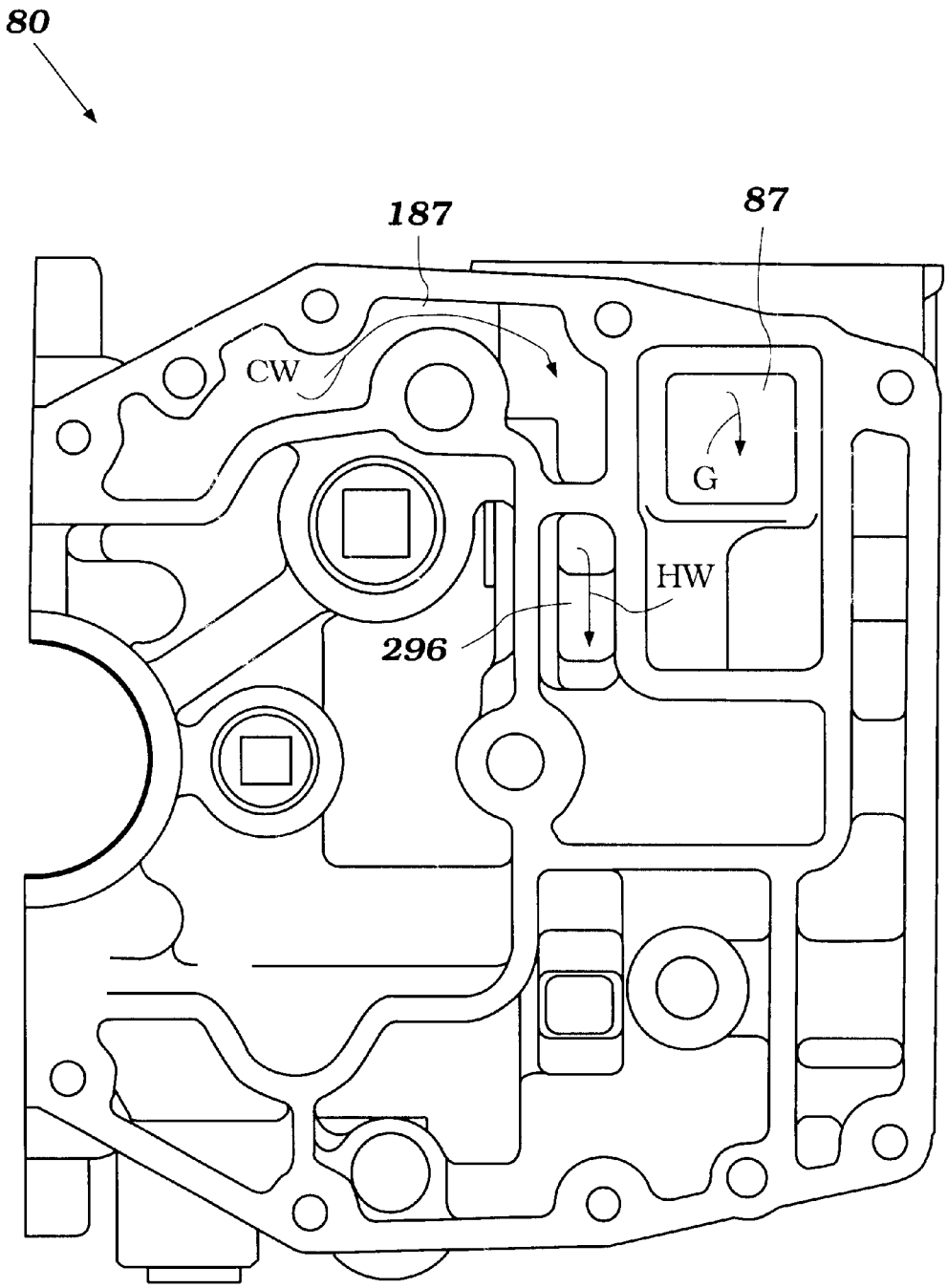
FIG. 10 is a bottom plan view of a cylinder block.

An exhaust manifold 87 (FIG. 10) is defined next to the cylinder bores 82 in the cylinder block 80. The exhaust manifold 87 preferably extends generally vertically. The exhaust manifold 87 communicates with the exhaust ports to collect exhaust gases from the combustion chambers 88 through the respective exhaust ports. The exhaust manifold 87 is coupled with the exhaust passage 79 of the exhaust guide member 78. When the exhaust ports are opened, the combustion chambers 88 communicate with this exhaust passage 79 through the exhaust manifold 87.

A valve cam mechanism preferably is provided for actuating the intake and exhaust valves. In the illustrated embodiment, the cylinder head assembly 86 journals a single or double camshaft arrangement 104, which extends generally vertically. The camshafts 104 actuate the intake valves and exhaust valves. The camshafts 104 have cam lobes to push the intake and exhaust valves in a controlled timing to open and close the intake and exhaust ports. Other conventional valve drive mechanisms can be employed instead of such a mechanism using one or more camshafts.

A camshaft drive mechanism is provided for driving the valve cam mechanism. The camshafts 104 have driven sprockets 106 positioned atop thereof and the crankshaft 92 has a drive sprocket 108 positioned almost atop thereof. A timing chain or belt 110 is wound around the drive and driven sprockets 108, 106. The crankshaft 92 thus drives the camshafts 104 with the timing chain 110 in timed relationship. A diameter of the driven sprockets 106 preferably is twice as large as a diameter of the drive sprocket 106. The camshafts 104 thus rotate at half of the speed of the rotation of the crankshaft 92.

The engine 58 preferably has a port or manifold fuel injection system. The fuel injection system preferably comprises four fuel injectors with one fuel injector allotted for each of the respective combustion chambers 88. Each fuel injector preferably has an injection nozzle directed toward the associated intake passage adjacent to the intake ports. The fuel injector also preferably has a plunger that normally closes the nozzle and a solenoid coil that moves the plunger from the closed position to an open position when energized with electric power. The fuel injectors spray fuel into the intake passages under the control of an ECU (electronic control unit). The ECU controls energizing timing and duration of the solenoid coils so that the plungers open the nozzles to spray a proper amount of fuel into the engine 58 during each combustion cycle. Of course, in some arrangements, the fuel injectors can be disposed for direct cylinder injection and, in other arrangements, carburetors can replace or accompany the fuel injectors.

The engine 58 further comprises an ignition or firing system. Each combustion chamber 88 is provided with a spark plug connected to the ECU so that ignition timing can be controlled by the ECU. The spark plugs have electrodes that are exposed into the associated combustion chamber and that ignite an air/fuel charge in the combustion chamber at selected ignition timings. The ignition system preferably has an ignition coil and an igniter.

The ignition coil preferably is a combination of a primary coil element and a secondary coil element that are wound around a common core. Desirably, the secondary coil element is connected to the spark plugs, while the primary coil element is connected to the igniter. Also, the primary coil element is coupled with a power source so that electrical current flows therethrough. The igniter abruptly cuts off the current flow in response to an ignition timing control signal from the ECU and then a high voltage current flow occurs in the secondary coil element. The high voltage current flow forms a spark at each spark plug.

In the illustrated engine 58, the pistons 84 reciprocate between top dead center and bottom dead center. When the crankshaft 92 makes two rotations, the pistons generally move from top dead center to bottom dead center (the intake stroke), from bottom dead center to top dead center (the compression stroke), from top dead center to bottom dead center (the power stroke) and from bottom dead center to top dead center (the exhaust stroke). During the four strokes of the pistons 84, the camshafts 104 make one rotation and actuate the intake and exhaust valves to open the intake ports during the intake stroke and to open exhaust ports during the exhaust stroke, respectively.

Generally, at the beginning of the intake stroke, air preferably is drawn through the air intake passages and fuel preferably is injected into the intake passage by the fuel injectors. The air and the fuel thus are mixed to form the air/fuel charge in the combustion chambers. Just before or during the power stroke, the respective spark plugs ignite the compressed air/fuel charge in the respective combustion chambers. The engine 58 thus continuously repeats the foregoing four strokes during its operation.

During the engine operation, heat builds in the engine body 96, the exhaust manifold 87 and various peripheral engine components disposed around the engine body 96. One purpose for the employment of the cooling system 32 is to help cool such engine portions and engine components. In the illustrated arrangement, the engine body 96 has one or more water jackets through which water runs to remove the heat from those engine portions and components. The outboard motor 30 preferably employs an open-loop type water cooling system that introduces cooling water from the body of water surrounding the motor 30 and then returns the water to the water body. A water introduction device, delivery passages and discharge passages can be defined within the housing unit 52. The illustrated cooling system will be described in greater detail later with further reference to the remaining figures.

The engine 58 preferably includes a lubrication system. Although any type of lubrication systems can be applied, a closed-loop type of system is employed in the illustrated embodiment. The lubrication system comprises a lubricant tank 114 defining a reservoir cavity 116 preferably positioned within the driveshaft housing 54. In some applications, the lubricant tank 114 is not positioned within the outboard motor while in other applications (i.e., the tank 114 is positioned on the watercraft rather than on the outboard motor), a lubricant holding tank is integrally formed with the crank chamber. An oil pump 117 is provided at a desired location, such as a lowermost portion of the camshaft 104, to pressurize the lubricant oil in the reservoir 114 and to pass the lubricant oil through a suction pipe toward engine portions, which are desirably lubricated, through lubricant delivery passages. The engine portions that need lubrication include, for instance, the crankshaft bearings, the connecting rods 94 and the pistons 84. Lubricant return passages also are provided to return the oil to the lubricant tank 114 for re-circulation. Preferably, the lubrication system further comprises a filter assembly to remove foreign matter (e.g., metal shavings, dirt, dust and water) from the lubricant oil before the oil is recirculated or delivered to the various engine portions. The cylinder head assembly 86 has a lubricant supply inlet 118 that communicates with the lubricant tank 114, while the lubricant tank 114 has a drain 120 at a rear bottom portion thereof. A plug 122 closes the drain 120. A structure of the lubricant tank 114 will be described greater in detail with further reference to some of the remaining figures.

A flywheel assembly 126 preferably is positioned above atop the crankshaft 92 and is mounted for rotation with the crankshaft 92. The illustrated flywheel assembly 126 comprises a flywheel magneto or AC generator that supplies electric power to various electrical components such as the fuel injection system, the ignition system and the ECU.

The driveshaft housing 54 depends from the power head 50. More specifically, a top end of the illustrated driveshaft housing 54 is affixed to the bottom end of the exhaust guide member 78 with bolts. The driveshaft housing 54 supports a driveshaft 130 which is driven by the crankshaft 92. The driveshaft 130 extends generally vertically through the driveshaft housing 54. The driveshaft 130 preferably drives the oil pump also. The driveshaft housing 54 also supports an exhaust pipe or conduit 132, which forms a portion of the exhaust system 100. An idle discharge section is also defined in the driveshaft housing 54. The idle discharge section includes an idle expansion chamber 134 and an idle discharge port 136. A drain 137 is preferably formed at a bottom end of the expansion chamber 134 to drain water in the chamber 134. An apron 138 covers an upper portion of the driveshaft housing 54 and improves the overall appearance of the outboard motor 30. The apron 138 has openings through which the exhaust discharge port 136, the water drain 137 and the oil drain 120 communicate exterior of the apron 138.

For readers' convenience in understanding exhaust gas flows, the sign "G" indicates the exhaust gas flow made above idle and the sign "IG" indicates the exhaust gas flow made at idle. The exhaust pipe 132 and the idle discharge section will be described in greater detail later with further reference to the remaining figures.

The lower unit 56 depends from the driveshaft housing 54 and supports a propulsion shaft 142, which is driven by the driveshaft 130. The propulsion shaft 142 extends generally horizontally through the lower unit 56. A propulsion device is attached to the propulsion shaft 142 and is powered through the propulsion shaft 142. In the illustrated arrangement, the propulsion device is a propeller 144 that is affixed to an outer end of the propulsion shaft 142. The propulsion device, however, can take the form of a dual counter-rotating system, a hydrodynamic jet, or any of a number of other suitable propulsion devices.

A transmission 146 preferably is provided between the driveshaft 130 and the propulsion shaft 142. The transmission 146 couples together the two shafts 130, 142 which lie generally normal to each other (i.e., at a 90-shaft angle) with bevel gears. The outboard motor 30 has a switchover or clutch mechanism that allows the transmission 146 to change the rotational direction of the propeller 144 among forward, neutral or reverse.

The lower unit 56 also defines an internal passage of the exhaust system 100. An expansion chamber 150 occupies major volume of the passage and is formed above a space where the propulsion shaft 142 extends so that the exhaust pipe 132 communicates with the expansion chamber 150. At engine speeds above idle, the exhaust gases generally are discharged to the body of water surrounding the outboard motor 30 through the internal passage and finally through a discharge section defined within the hub of the propeller 144. The foregoing idle discharge section is provided for lower speed engine operation. The difference in the locations of the discharges accounts for the differences in pressure at locations above the waterline and below the waterline. Because the opening above the line is smaller, pressure develops within the lower unit 56. When the pressure exceeds the higher pressure found below the waterline, the exhaust gases exit through the hub of the propeller 144. If the pressure remains below the pressure found below the waterline, the exhaust gases exit through the idle discharge section including the discharge port 136 above the waterline.

With reference still to FIGS. 1 and 2 and additionally to FIGS. 3–21, the cooling system 32, the exhaust system 100, the lubricant tank 114 and mutual relationships among them now will be described in great detail.

The lubricant tank 114 is preferably formed with a separate piece and depends from a bottom end of the exhaust guide member 78. The lubricant tank 114 can be configured with a recessed portion 160 that opens downward at a center portion thereof. An aperture 162 is defined at the center of the illustrated lubricant tank 114. The lubricant tank 114 preferably affixed to the bottom end of the exhaust guide member 78 by bolts at a location such that the aperture 162 communicates with the exhaust passage 79 of the exhaust guide member 78. A gasket 164 can be interposed between the bottom end of the exhaust guide member 78 and a top end of the lubricant tank 114.

The exhaust pipe 132 depends from the lubricant tank 114 with its top end resting atop the recessed portion 160. The exhaust pipe 132 thus extends downward through and beyond the recessed portion 160. Because an inner diameter of the recessed portion 160 is greater enough than an outer diameter of the exhaust pipe 132, a space is defined between the exhaust pipe 132 and the lubricant tank 114.

The exhaust pipe 132 preferably is made of stainless steel and is treated by electrically isolation treatment and/or corrosion-proof treatment. For instance, zinc powder chromic acid composite coating treatment (or dicrotizing treatment) and ceramic coating treatment are available. The exhaust pipe 132 thus is resistant against sulfuric acid corrosion.

The exhaust pipe 132 has an upper flange 166 and is affixed to a center portion 167 of the lubricant tank 114, which is located above the recessed portion 160. In the illustrated embodiment, one or more bolts 168 for affixing the center portion 167 of the lubricant tank 114 to the exhaust guide member 78 can be used for affixing the exhaust pipe 132.

Figure 3:
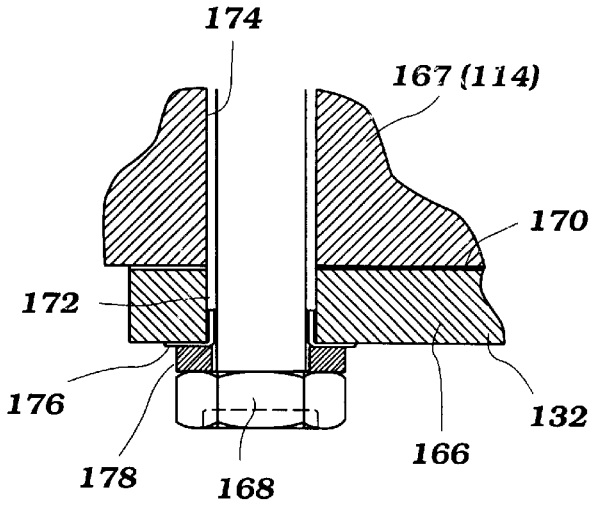
FIG. 3 is a still enlarged sectional view of a portion of the driveshaft housing encircled and indicated by reference numeral 3 of FIGS. 1 and 2.

As best seen in FIG. 3, the flange 166 of the exhaust pipe 132 abuts on the center portion 167 via a gasket 170, and the bolts 168 are inserted through bolt holes 172 of the flange 166 and bolt holes 174 of the center portion 167. Collars 176 and washers 178 preferably are interposed between the flange 166 and the bolts 168. While the gasket 170 is coated with an electrically insulating material, the collar 176 and the washer 178 preferably are made of metal and are also coated with an electrically insulating material. An inner diameter of each bolt hole 172, 174 is slightly larger than an outer diameter of each bolt 168, and the bolts 168 are threaded to the exhaust guide member 78. Because of this construction, the bolts 168 are secured in position, and the bolts 168, the exhaust pipe 132 and the lubricant tank 114 can be well insulated.

As seen in FIG. 2, the exhaust guide member 78 defines a cover portion 182 of the lubricant tank 114 on a bottom side. The cover portion 182 generally surrounds the exhaust passage 79. The exhaust guide member 78 also defines a water collection area 184 that communicates with a water delivery area 187 defined next to the exhaust manifold 87 in a bottom of the cylinder block 80. The coolant water is delivered to the water jackets of the illustrated engine body 96 through the collection area 184 and the delivery area 187.

A water inlet port 188 is defined in the lower unit 56 at a location submerged when the drive unit 34 is tilted down. A water inlet passage 190, which is also defined in the lower unit 56, and a water supply pipe 192 extending vertically through the driveshaft housing 54 together connect the inlet port 188 to the collection area 184 in the exhaust guide member 78. Because the collection area 184 is formed on an upper side of the exhaust guide member 78, as seen in FIG. 9, the pipe 192 is connected to an opening 193 (FIG. 8) that communicates with the collection area 184. A water pump 194 is disposed at a bottom portion of the driveshafi housing 54 to couple the inlet passage 190 with the supply pipe 192 and to pressurize water for delivery to the collection area 184. The water pump 194 preferably is driven by the driveshaft 130.

For readers' better understanding, as used through this description, the sign "CW" means that the cooling water in the passages, conduits or areas where the sign is indicated is fresh or relatively cold because the water generally has not run through the water jackets of the engine body 96, while the sign "HW" means that the cooling water is heated or relatively hot because it has circulated within at least a portion of the engine body 96. For instance, the water in the inlet passage 190, the supply pipe 192, the collection area 184 and the delivery area 187 is cold as indicated by the sign "CW".

The exhaust pipe 132 preferably extends down to almost a bottom end of the driveshaft housing 54. The driveshaft housing 54 has an internal wall 200 extending from the bottom end of the driveshaft housing 54 to surround the exhaust pipe 132. The internal wall 200 preferably is unitarily formed with the driveshaft housing 54 so as to define a water pool 202 that is generally configured as a relatively deep vessel shape. The exhaust pipe 132 extends downward beyond a bottom end of the vessel shape.

Figure 13:
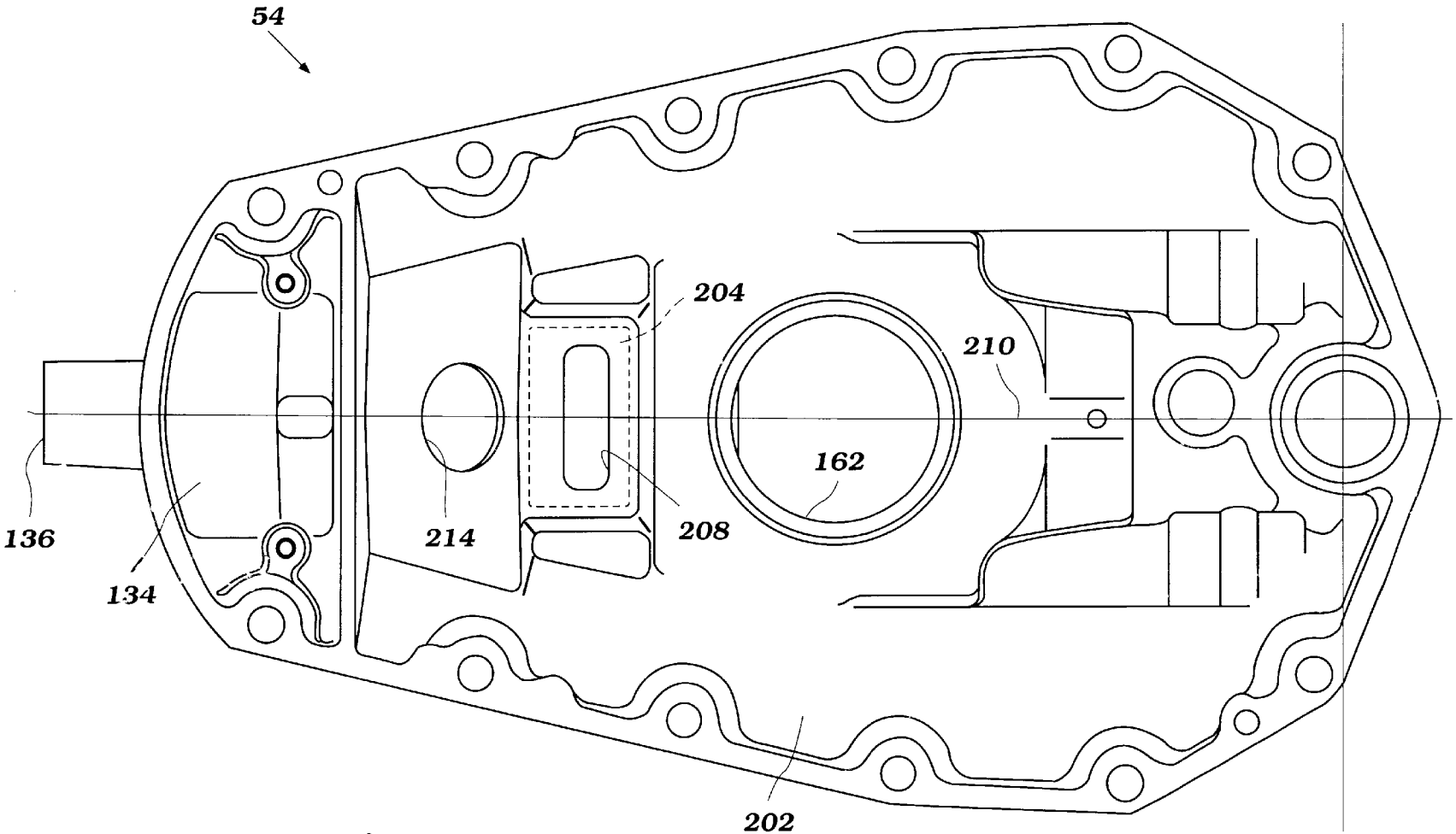
FIG. 13 is a top plan view of the driveshaft housing.
Figure 14:
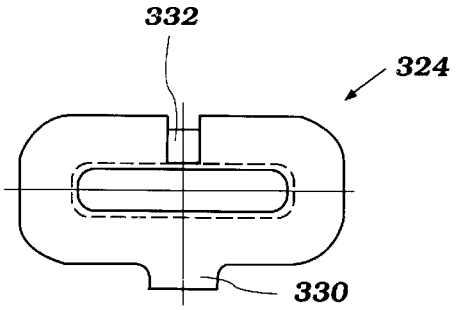
FIG. 14 is a top plan view of a water discharge conduit.
Figure 15:
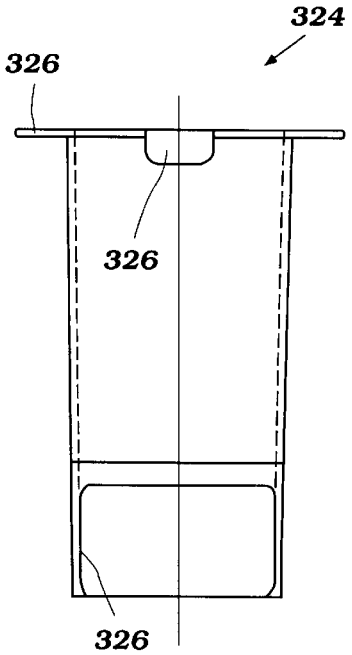
FIG. 15 is front view of the water discharge conduit.
Figure 16:
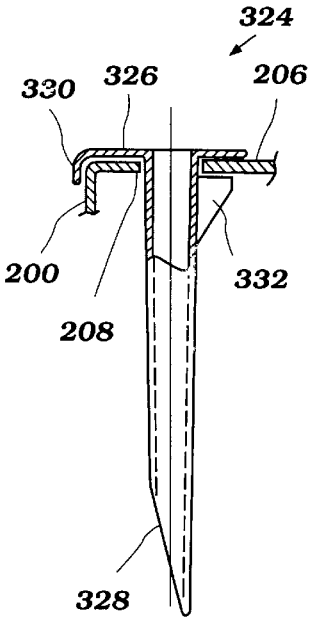
FIG. 16 is a side view of the water discharge conduit. The conduit is shown partially in section and as attached onto an internal wall.
Figure 17:
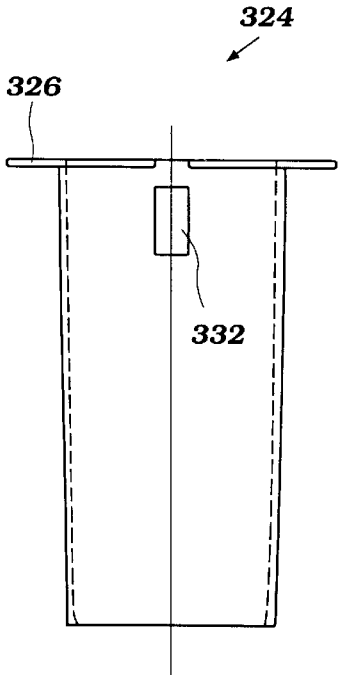
FIG. 17 is a rear view of the water discharge conduit.

As best seen in FIGS. 2 and 13, a space 204 is formed generally between a rear, inner surface of the driveshaft housing 54 and a rear, outer surface of the internal wall 200. The rear, outer surface of the internal wall 200 has a horizontal portion 206 that connects the internal wall 200 to the inner surface of the driveshaft housing 54. The space 204 communicates with the water pool 202 through a slot 208 which has longer sides extending normal to a horizontal axis 210, which extends fore to aft of the driveshaft housing 54.

The internal wall 200 merges with a common wall portion 212 of the driveshaft housing 54 extending above the horizontal portion 206. An oil drain hole 214 for the lubricant tank 114 is formed at this common wall portion 212 so that a drain pipe 216, which preferably is unitarily formed with the apron 138, communicates with the oil drain 120. A seal member (not shown) preferably seals around the drain pipe 216 within the drain hole 214. The internal wall 200 separates from the driveshaft housing 54 above the common wall portion 212 to define an upper wall portion 218 which separates the water pool 202 from the idle expansion chamber 134. The lubricant tank 114 thus is placed within the water pool 202.

Figure 4:
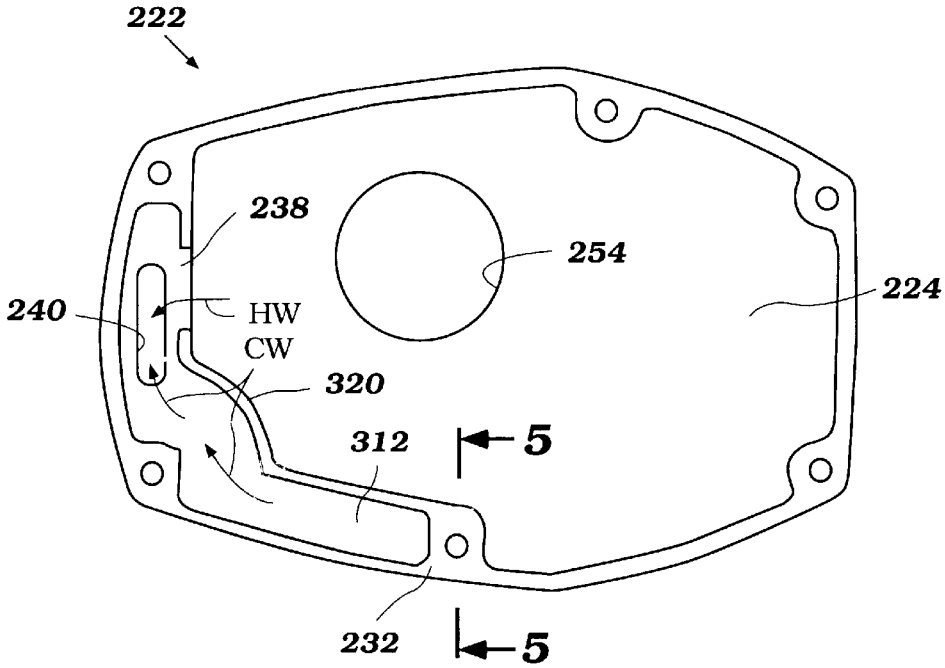
FIG. 4 is a top plan view of a partition member.
Figure 5:
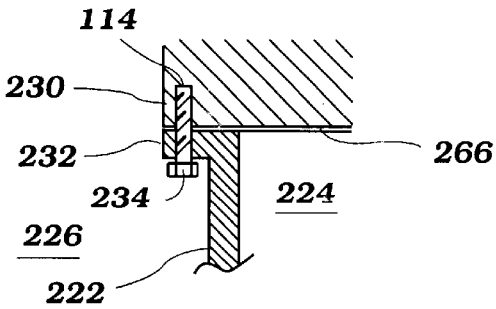
FIG. 5 is a sectional view taken along the line 5—5 of FIG. 4.
Figure 6:
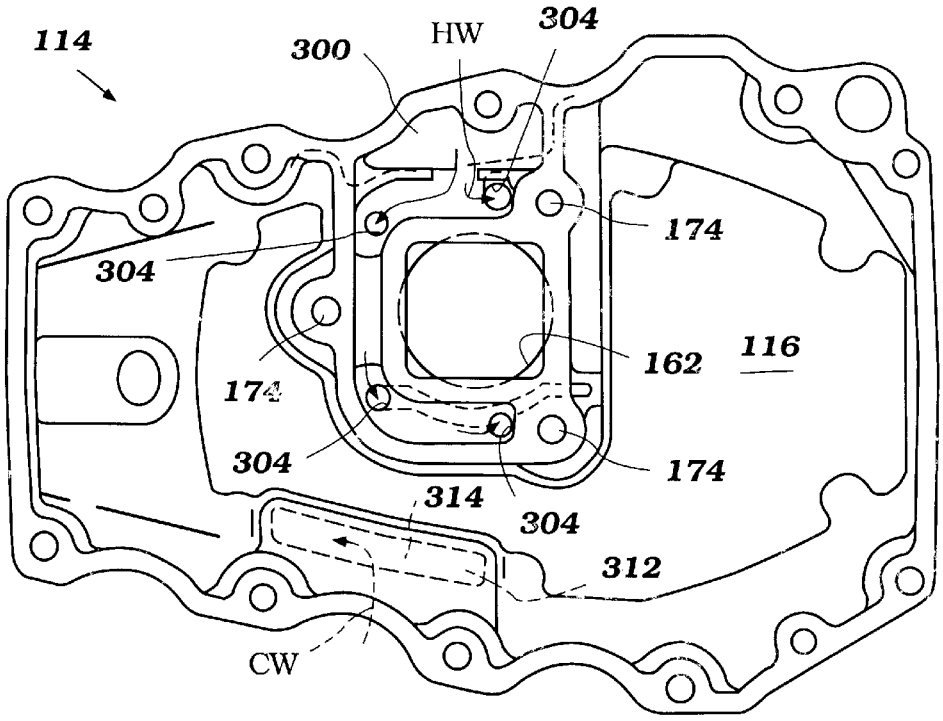
FIG. 6 is a top plan view of the lubricant tank.
Figure 7:
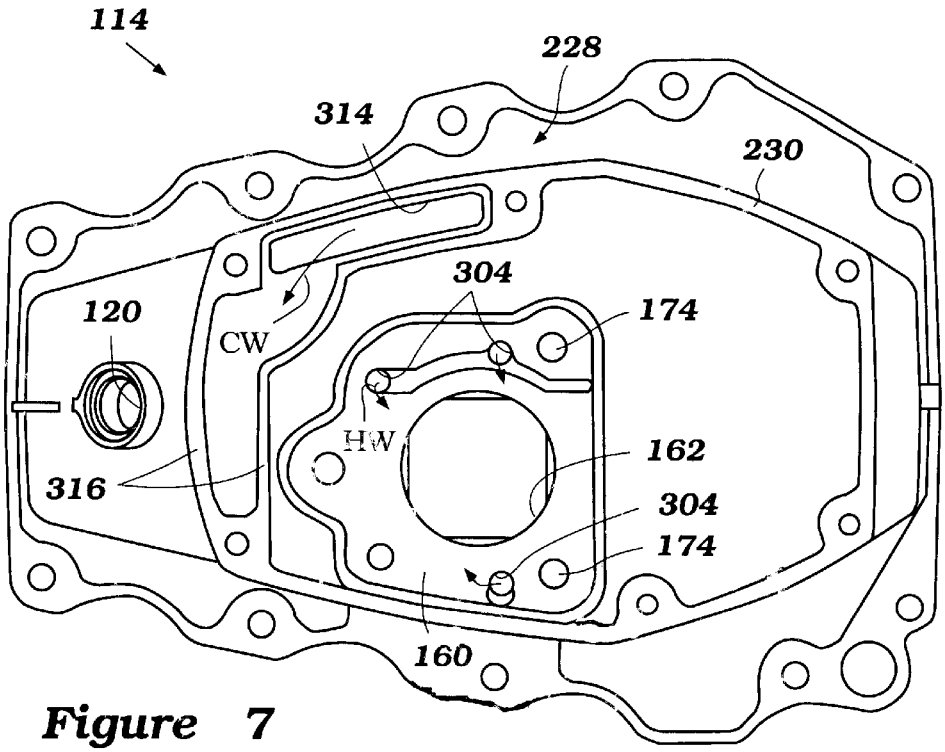
FIG. 7 is a bottom plan view of the lubricant tank.

The driveshaft housing 54 further preferably has a partition member 222 disposed generally within the internal wall 200 to surround the exhaust pipe 132. The partition member 222 divides the water pool 202 into an inner pool 224 and an outer pool 226. In some applications, however, the water pool 202 is not divided into more than one portion while, in other applications, the water pool 202 is divided into more than two sub-pools. Preferably, a relatively cooler pool is interposed between a relatively warmer pool and the driveshaft housing 54 or another portion of the outer member of the outboard motor, which is in contact with the water in which the vehicle is operating. The partition member 222 preferably is formed with a separate piece that has also a relatively deep vessel shape and depends from a bottom end 228 of the lubricant tank 114. As seen in FIGS. 4, 5 and 7, the bottom end 228 of the lubricant tank 114 has a flange 230 extending downward, while the partition member 222 has a flange 232 atop thereof. The partition member 222 is affixed to the lubricant tank 114 with bolts 234 so that the respective flanges 230, 232 confront with each other. Because of this arrangement, the inner pool 224 entirely surrounds the exhaust pipe 132 and then the outer pool 226 surrounds the inner pool 224 and the lubricant tank 114.

The partition member 222 has a weir 238 to form a spillway that communicates with the slot 208 through a spillover pathway 240. That is, the spillover pathway 240 extends through the outer pool 226 so as to couple the inner pool 224 directly with the slot 208. A portion of the spillover pathway 240 preferably is formed with a separate intermediate piece 242, although the pathway 240 of course can be formed with as a portion of the partition member 222.

The internal wall 200 has a bottom portion 246 defining a step 248 at which an opening 250 for the exhaust pipe 132 is formed. A bottom portion 252 of the partition member 222, which also defines an opening 254 for the exhaust pipe 132, is seated on the step 248 via a seal member 256 so that a bottom end of the outer pool 226 is completely closed. While the bottom portion 252 of the partition member 222 has a step 258, the exhaust pipe 132 has a lower flange 260 which preferably is a separate piece and is affixed circumferentially around the pipe 132. The flange 260 is seated on the step 258 via a seal member 262 so that a bottom end of the inner pool 224 also is completely closed. Each bolt 234 (FIG. 5) has sufficient length of its threaded area that is longer than an actual thrust length thereof, while the partition member 222 is slightly shorter than a length of dimensions. Because of this arrangement, the seal member 262 can be compressed so as to ensure a sufficient sealing effect. For this purpose, the seal member 256 desirably has a length sufficient enough so as to be compressed by relatively small force. In other words, the bolts 234 act as a thrust fastener so that the step 258 urges the seal member 262 upward toward the flange 260. A small gap 266 may be made between the flanges 230 and 232. This gap 266, however, is allowable because the flanges 230, 232 merely separate the inner and outer pools 224, 226, both containing water.

It should be noted, in the illustrated embodiment, that because the exhaust pipe 132 has a sufficient length to extend downward beyond the opening 254 of the partition member 222, the exhaust pipe 132 itself is available as a guide member for placing the partition member 222 at an accurate position in the driveshaft housing 54. The arrangement thus can expedite the assembly work of the partition member 222.

Figure 11:
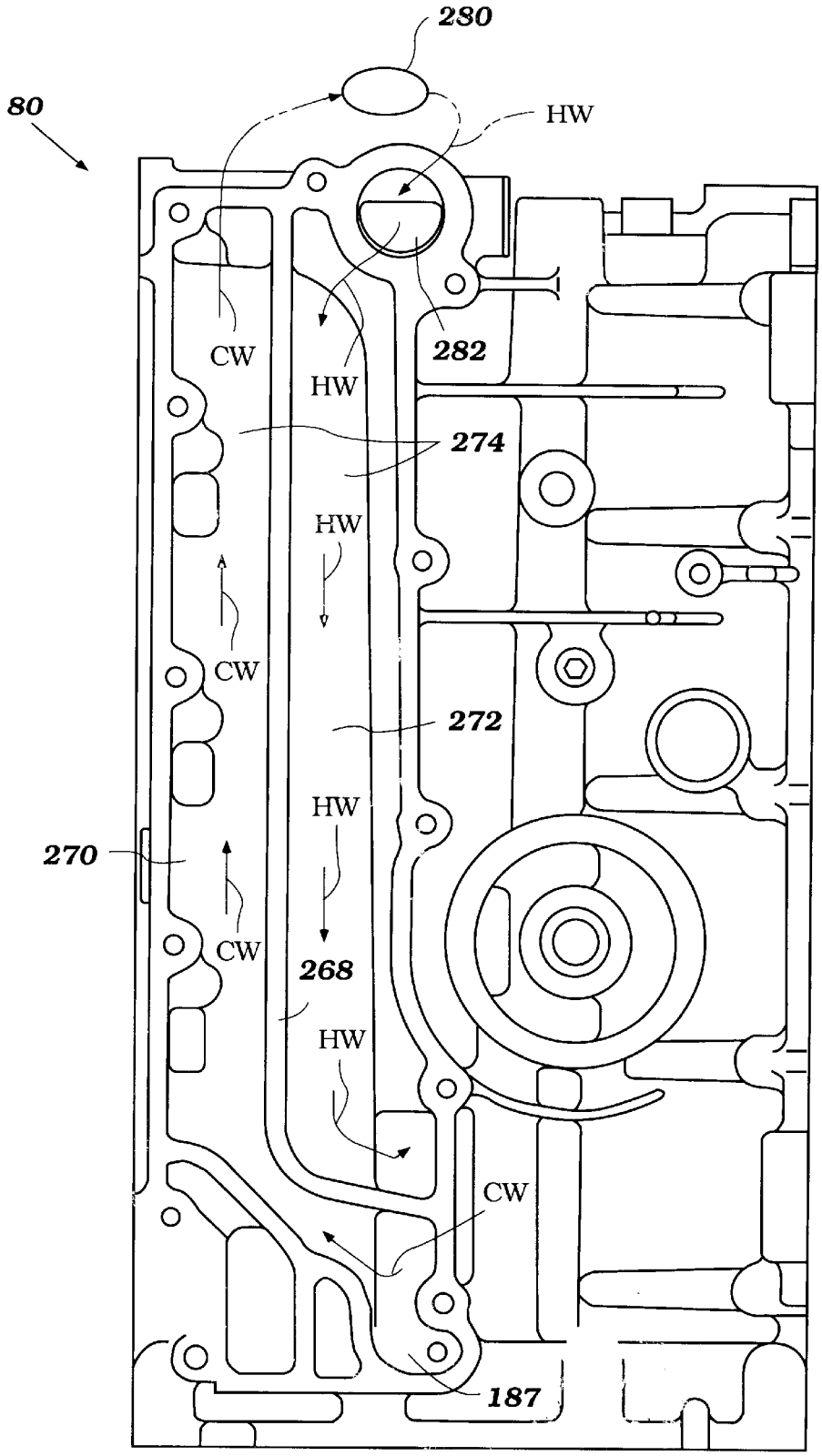
FIG. 11 is a side elevational view of the cylinder block on the port side.
Figure 12:
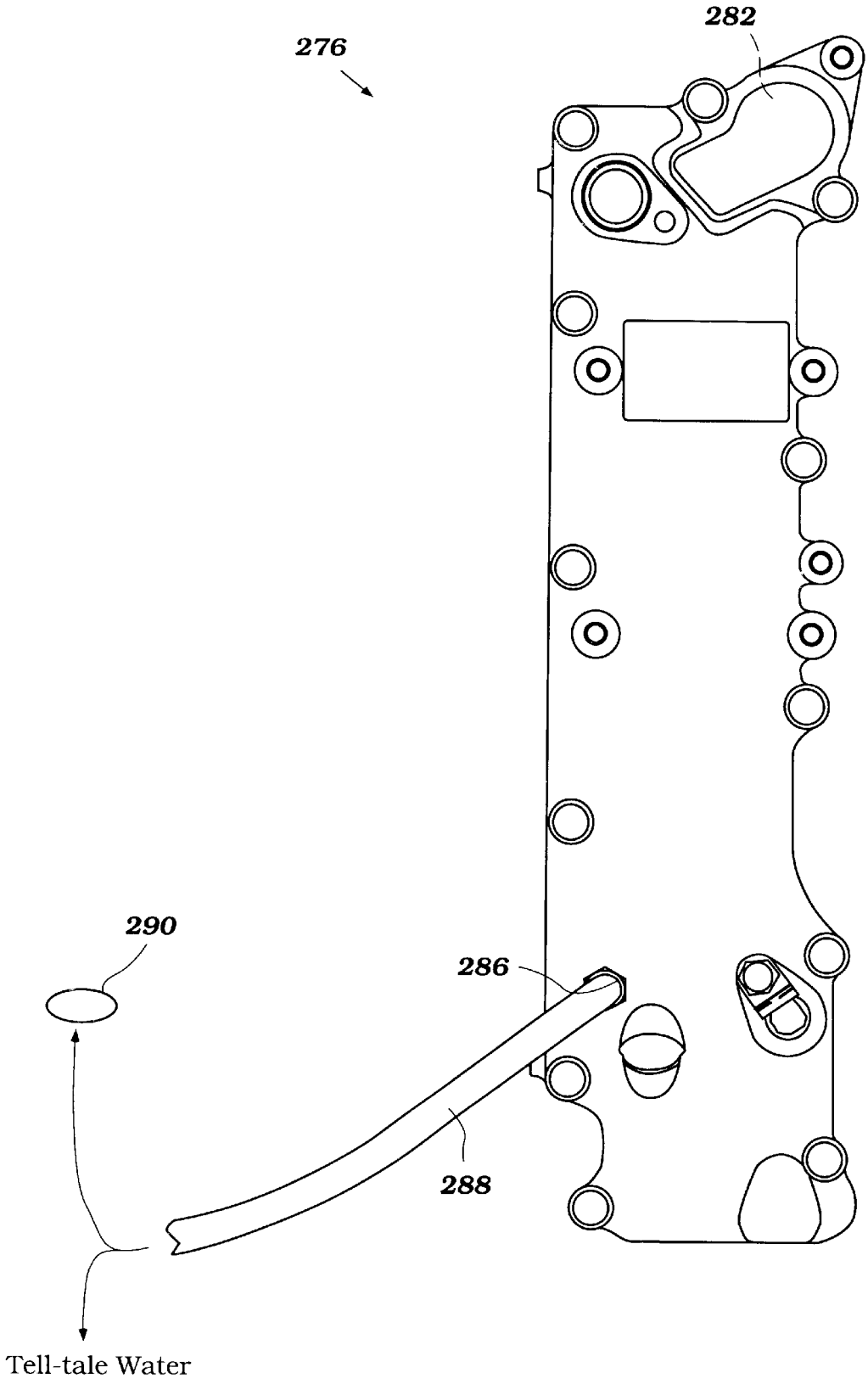
FIG. 12 is a side elevational view of a removable water jacket member attached to the cylinder block.

As described above, the water delivery area 187 (FIG. 2) communicates with water jackets in the engine body 96. FIGS. 11 and 12 illustrate some of the water jackets. The water jackets preferably include a delivery water jacket 270 and a discharge water jacket 272. The cylinder block 80 has ditches 274 that are separated by a partition 268 from each other. Preferably, the partition 268 extends generally vertically on the port side. The ditches 274 define respective portions of the delivery and discharge water jackets 270, 272. A removable water jacket member 276 shown in FIG. 12 completes the water jackets 270, 272 when joined to the ditches 274.

As schematically illustrated in FIG. 11, the water supplied to the area 187 is delivered to cooling jackets 280 within the engine portions around, for example, the cylinder bores 82 and combustion chambers 88 through the delivery jacket 270 and then is transferred to the discharge jacket 272. A thermostat preferably is provided in a thermostat chamber 282 disposed between the cooling jackets 280 and the discharge jacket 272. The water flowing upstream in the cooling jackets 280 within the engine portions is relatively cold, while the water flowing downstream in the cooling jackets 280 is relatively hot during normal running operations. In a start-up operation and a warm-up operation, however, the water in a downstream portion of the cooling jackets 280 is still cold because the engine portions have not been warmed up. The thermostat inhibits the water from flowing into the discharge jacket 272 for awhile after the engine has started up so that the engine body 96 can be rapidly warmed up.

As seen in FIG. 12, the water jacket member 276 defines an opening 286 at the delivery jacket 270 and a flexible delivery pipe 288 is connected to the opening 286 at one end. The other side of the delivery pipe 288 bifurcates so that one end defines a tell-tale or pilot discharge port and the other end is connected to a branch delivery area 290 (FIG. 8) which is formed on a bottom side of the exhaust guide member 78. In the illustrated embodiment, as seen in FIG. 9, the delivery pipe 288 is coupled with an opening 292 on the upper side of the guide exhaust member 78 that communicates with the branch delivery area 290. The water at the branch delivery area 290 then falls into the outer pool 226. The water splashes over or descends down along the surface of the lubricant tank 114 when falling into the outer pool 226.

Any ratio of water distribution can be applied if a majority of the water is delivered to the engine portions 280. For instance, preferably, the ratio can be about 80% to the engine portions 280, about 20% (in many occasions, slightly less than 20%) to the outer pool 226 and the reminder to the tell-tale.

On the other hand, the water in the discharge jacket 272 goes down to an upper water discharge area 296 (FIG. 10) formed within the cylinder block 80. The water then flows into a middle water discharge area 298 (FIGS. 8 and 18) formed within the exhaust guide member 78. A top side of the lubricant tank 114 forms a lower water discharge area 300 (FIG. 6) communicating with the middle discharge area 298. The top side of the lubricant tank 114 is located within the center portion 167 of the tank 114. Several through-holes 304 are defined at the center portion 167 of the lubricant tank 114 to connect the lower discharge water area 300 with the recessed portion 160 formed between the lubricant tank 114 and the exhaust pipe 132. The water in the lower discharge area 300 thus falls into the inner pool 224 through the through-holes 304 and the recessed portion 160. The water splashes over or descends down along the surface of the lubricant tank 114 at the recessed portion when falling into the inner pool 224.

As thus described, while the outer pool 226 is provided with the water that has not run through the cooling jackets 280 within the engine portions, i.e., relatively cold water, the inner pool 224 is provided with the water that has run through the cooling jackets 280, i.e., hot or heated water. Because of this arrangement, the cold water confines the hot water so that the hot water does not heat or warm up the inner surface of the driveshaft housing 54. Accordingly, although water containing a calcium (Ca) component adheres on the outer surface of the driveshaft housing 54, the calcium (Ca) component does not change to white due to heating. Thus, the housing 54 is not substantially discolored in a manner that can deteriorate the appearance of the outboard motor 30.

The outer pool 226 preferably has a spillway 306 that allows the water in the pool 226 to spillover to the inner pool 224. In the illustrated embodiment, as seen in FIGS. 1 and 2, a vertical slot 308 opened at a vertical wall portion 310 of the lubricant tank 114 on the starboard side defines the spillway 306. The vertical slot 308 communicates with a spillover pathway 312 (FIGS. 1, 6 and 7) formed in the lubricant tank 114 through a horizontal slot 314. That is, a pair of wall portions 316 of the lubricant tank 114 defines the spillover pathway 312 therebetween and the horizontal slot 314 is defined horizontally atop the spillover pathway 312 and adjacent to the vertical slot 308.

When the water in the outer pool 226 reaches the spillway 306, it flows into the spillover pathway 312 through the vertical and horizontal slots 308, 314 and then goes down to the partition member 222 that continuously defines the spillover pathway 312 with a wall portion 320 (FIG. 4). The water then moves to the weir 238 that defines the spillway of the inner pool 224 and merges with the water from the inner pool 224. Because of merging with the relatively cold water coming from the outer pool 226, the relatively hot water coming from the inner pool 224 is properly cooled down and then both the water move together to the slot 240.

A water discharge conduit 324 preferably is provided at the slot 240 so as to extend down through the space 204. FIGS. 14–17 illustrate the water discharge conduit 324 and a connection of the conduit 324 with the slot 240. The discharge conduit 324 preferably is made of relatively soft plastic (synthetic resin) or heat-proof rubber and is configured as a flat pipe that has long sides extending generally normal to the horizontal axis 210 of the driveshaft housing 54. A flange 326 is formed atop thereof for attachment to the slot 240. The bottom end of the conduit 324 preferably is cut away obliquely so as to define an outlet opening 328. In order to direct the outlet opening 326 toward the internal wall 200 rather than the inner surface of the driveshaft housing 54, the top flange 326 has a positioning hook 330. The discharge conduit 324 also has a triangular projection 332 that extends opposite to the hook 330 at a location slightly apart from the flange 326 so that a space can be made which has a distance larger than a thickness of the horizontal portion 206 of the internal wall 200. The projection 332 prevents the conduit 324 from falling off from the slot 208.

The discharge conduit 324 is inserted through the slot 208. The top flange 326 is placed on the horizontal portion 206 and is interposed between the horizontal portion 206 and the intermediate piece 242. The intermediate piece 242 preferably is slightly slidable along its vertical axis so that a tolerance of the top flange 326 of the conduit 324 can be absorbed. As best seen in FIG. 2, the discharge conduit 324 is so fixed at the slot 208 that the outlet opening 328 is directed toward the internal wall 200 and also that a proper distance is kept between the conduit 324 and the inner surface of the driveshaft housing 54.

The space 204 is continuously formed within the lower unit 56 to define a water discharge pathway 335. A water outlet port or slits 336 are formed at almost the bottom of the discharge pathway 335. The water gathering at the slot 240 of the partition member 222 goes down to the slot 208 of the horizontal portion 206 of the internal wall 200 and then falls down to the discharge pathway 335 through the discharge conduit 324. The water reaches the outlet port 336 and is discharged out to the body of water. In some applications, the cooling water in the water pool or from the engine can be discharged, at least in part, through the hub of the propeller. However, when the water is discharged through the slits 336, the water generally is adequately cooled to reduce the amount of deposits forming about the slits 336 while also simplifying the exhaust system. As noted above, the temperature of the water is reduced (i.e., mild) as indicated by the sign MW of FIG. 2 because of the cold water mixed at the spillway 238. The driveshaft housing 54 thus is not heated and the discoloring of the housing 54 is greatly reduced.

As seen in FIG. 2, the partition member 222 has a small hole that defines a drain 340. The drain 340 is formed at a forward bottom end of the partition member 222 because the location is placed at the lowermost position when the drive unit 34 is tilted up and hence the entire water in the inner pool 224 can be drained out. Similarly, the internal wall 200 has also a small hole that defines a drain 342 formed at a forward bottom end of the internal wall 200. The entire water accumulated in the outer pool 226 thus can be also drained through the drain 342. The water from the outer pool 226 drained through the drain hole 342 falls down to the expansion chamber 150 and then goes out to the body of water through the hub of the propeller 144.

Because both the drains 340, 342 are small, the majority of the water in the inner and outer pools 224, 226 will not pass through the drains under the running conditions of the engine 58. In addition, as noted above, the spillway 306 of the outer pool 226 is positioned higher than the spillway 238 of the inner pool 224. That is, there is a head H between the spillway 306 and the spillway 238 as seen in FIG. 1. Because of this arrangement, the water in the inner pool 224 is inhibited from flowing out to the outer pool 226 while the water in the outer pool 226 can enter the inner pool 224. This is advantageous because the hot water in the inner pool 224 is cooled down with the cold water of the outer pool 226, but the hot water generally does not go out to the outer pool 226 through the drain 340.

While the exhaust pipe 132 is made of stainless steel as noted above, the components in the driveshaft housing 54 and the lower unit 56 except for the exhaust pipe 132 are made of aluminum alloy or iron material. Electrical corrosion thus can occur on such components due to differences of the ionization tendency between the components and the exhaust pipe 132. In order to inhibit the electrical corrosion, anodes 346, 348, 350 preferably are affixed to the bottom portion 228 of the lubricant tank 114, the bottom portion 246 of the internal wall 200 and an internal wall 352 of the lower unit 56, which defines the expansion chamber 150, respectively. The anodes 346, 348, 350 are made of, for example, zinc (Zn) and affixed to appropriate locations of the respective components by bolts.

Figure 8:
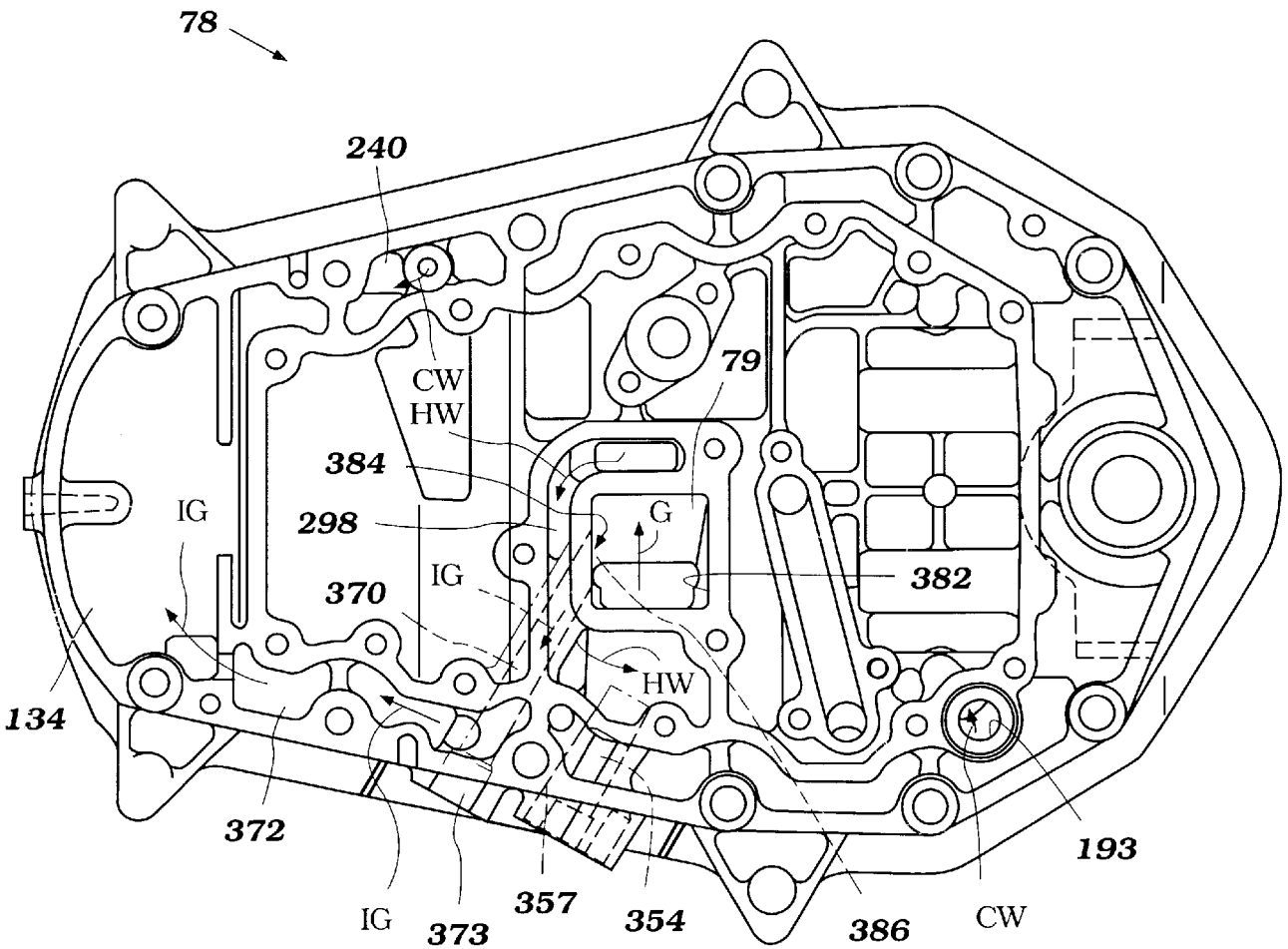
FIG. 8 is a bottom plan view of an exhaust guide member.
Figure 9:
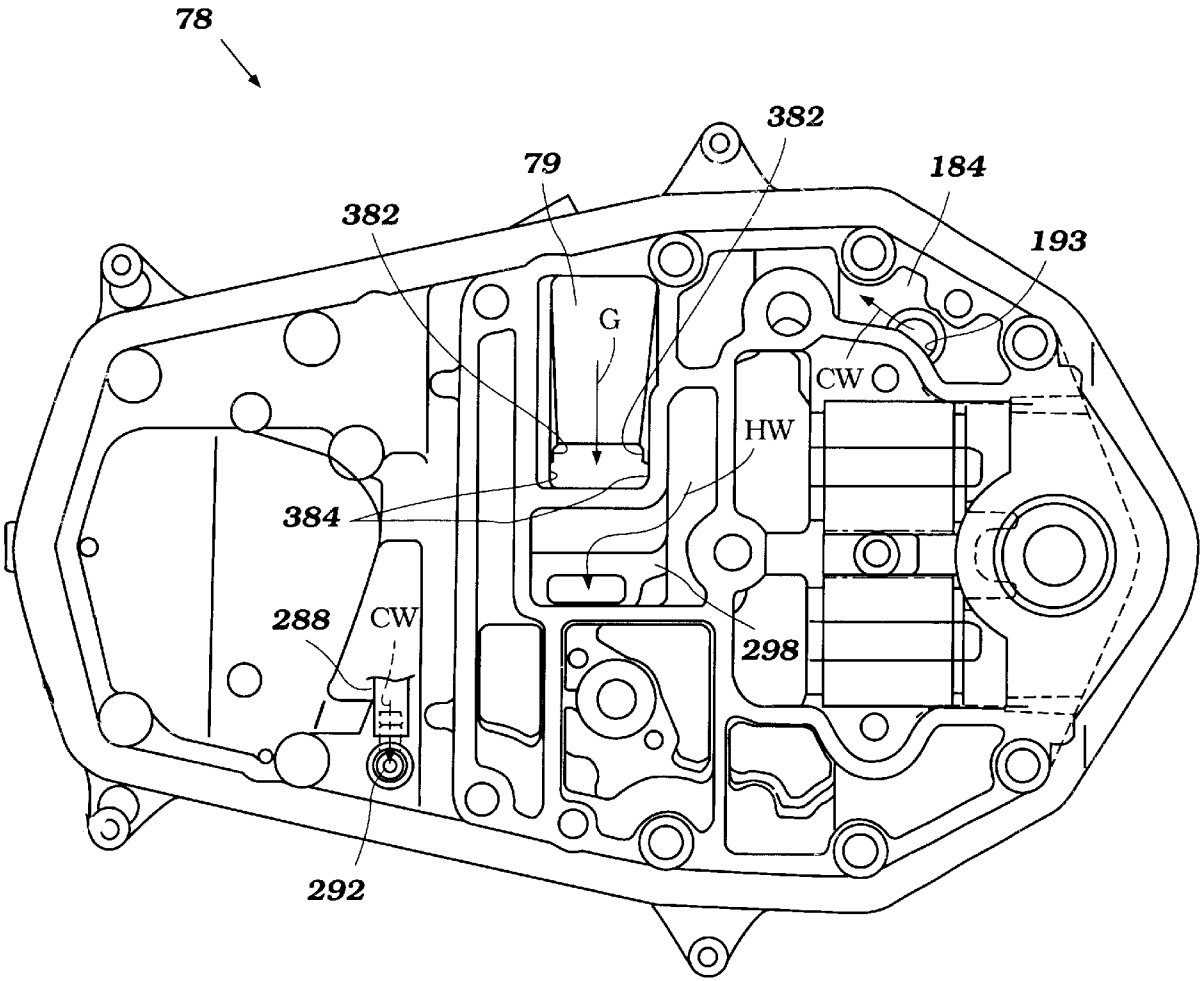
FIG. 9 is a top plan view of the exhaust guide member.
Figure 18:
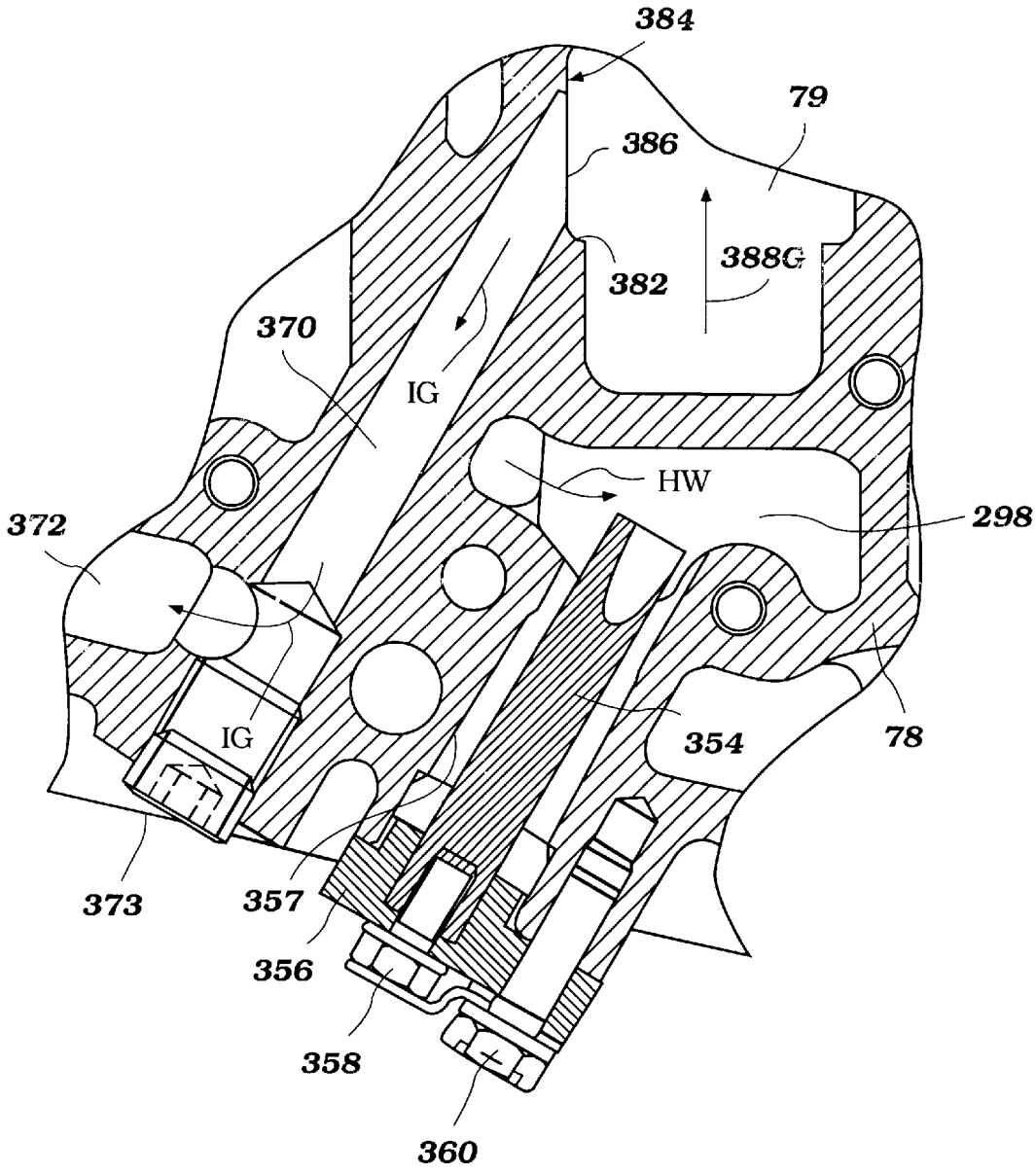
FIG. 18 is a partially sectional bottom view of the exhaust guide member to show an idle exhause passage and an anode unit.
Figure 19:
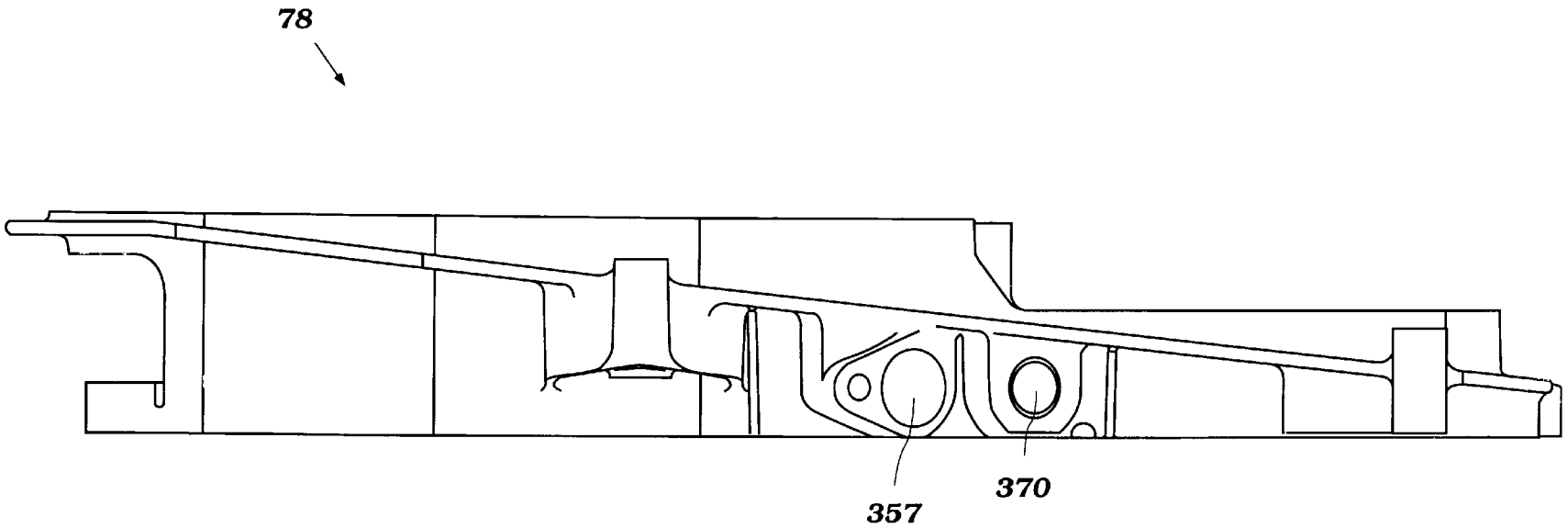
FIG. 19 is a side view of the exhaust guide member on the port side without closure members for a first idle passage and for an opening of a middle water discharge area.

In the illustrated embodiment, as seen in FIGS. 8 and 18, one more anode 354 is provided in the middle water discharge area 298 formed between the bottom side of the exhaust guide member 78 and the top side of the lubricant tank 114. The anode 354 is also made of, for example, zinc (Zn) and is assembled with a closure member 356 by a bolt 358. The exhaust guide member 78 defines an opening 357 extending from the water area 298. The anode 354 is inserted into the opening 357 with the closure member 356 that closes the opening 357. An axis of the anode 354 preferably coincides with an axis of the opening 357. The attachment of the anode 354 is completed by a bolt 360 which extends in parallel to the anode 354 and the opening 357, and affixes a portion of the closure member 356 to the exhaust guide member 78.

The anode unit is previously assembled with the exhaust guide member 78. This pre-assembly can reduce work load at an assembly line of the outboard motor 30 or the engine 58 and thus can decrease production cost. In addition, the anode unit is easily detachable by loosening the bolt 360 under the condition that the apron 138 is removed. This simple construction allows the user, operator and/or repair person to conduct maintenance work or exchange work of the anode unit.

The water discharge pathway 335 is divided from the expansion chamber 150 by a dividing wall 364 that is formed with a portion of the internal wall 200 extending downward and a portion of the lower unit 56 extending upward. Because almost all of the water is routed out through the discharge pathway 204 and does not meet with exhaust gases, sulfuric acid corrosion, which can occur when sea water and exhaust gases meet with one another, hardly occurs.

The exhaust pipe 132 has an outlet 366 that preferably opens substantially atop of the expansion chamber 150. The exhaust gases abruptly expand within the expansion chamber 150. The energy of the exhaust gases thus is reduced and the exhaust noise associated with the exhaust system can be greatly attenuated. Of course, the exhaust pipe 132 can extend further into the expansion chamber 150 as shown in phantom line of FIGS. 1 and 2. In this arrangement, the outlet 366 is positioned far from the seal member 256 so that the seal member 256 has less chance to be deteriorated by heat of exhaust gases discharged from the outlet 366.

As noted above, the majority of exhaust gases are routed out to the body of water through the hub portion of the propeller 144. At idle engine speed, the exhaust gases are discharged through the idle discharge section that includes the idle expansion chamber 134 and the idle discharge port 136. As seen in FIGS. 8 and 18, the idle expansion chamber 134 communicates with the exhaust passage 79 through the first and second idle passages 370, 372. The middle water discharge area 298 generally surrounds the exhaust passage 79. The opening 357 of the discharge area 298 and the first idle passage 370 are generally parallel to each other.

The first idle passage 370 is formed within the exhaust guide member 78 by a machining method. In some applications, the second idle passage 372 can be completely formed in the exhaust guide member 78 as well. Because the idle passage 370, the opening 357 and the bolt 360 are generally parallel with each other, only one machining process is necessary and sufficient for drilling them. A closure member 373 closes a machining hole so that the first idle passage 370 communicates only with the second idle passage 372.

Figure 20:
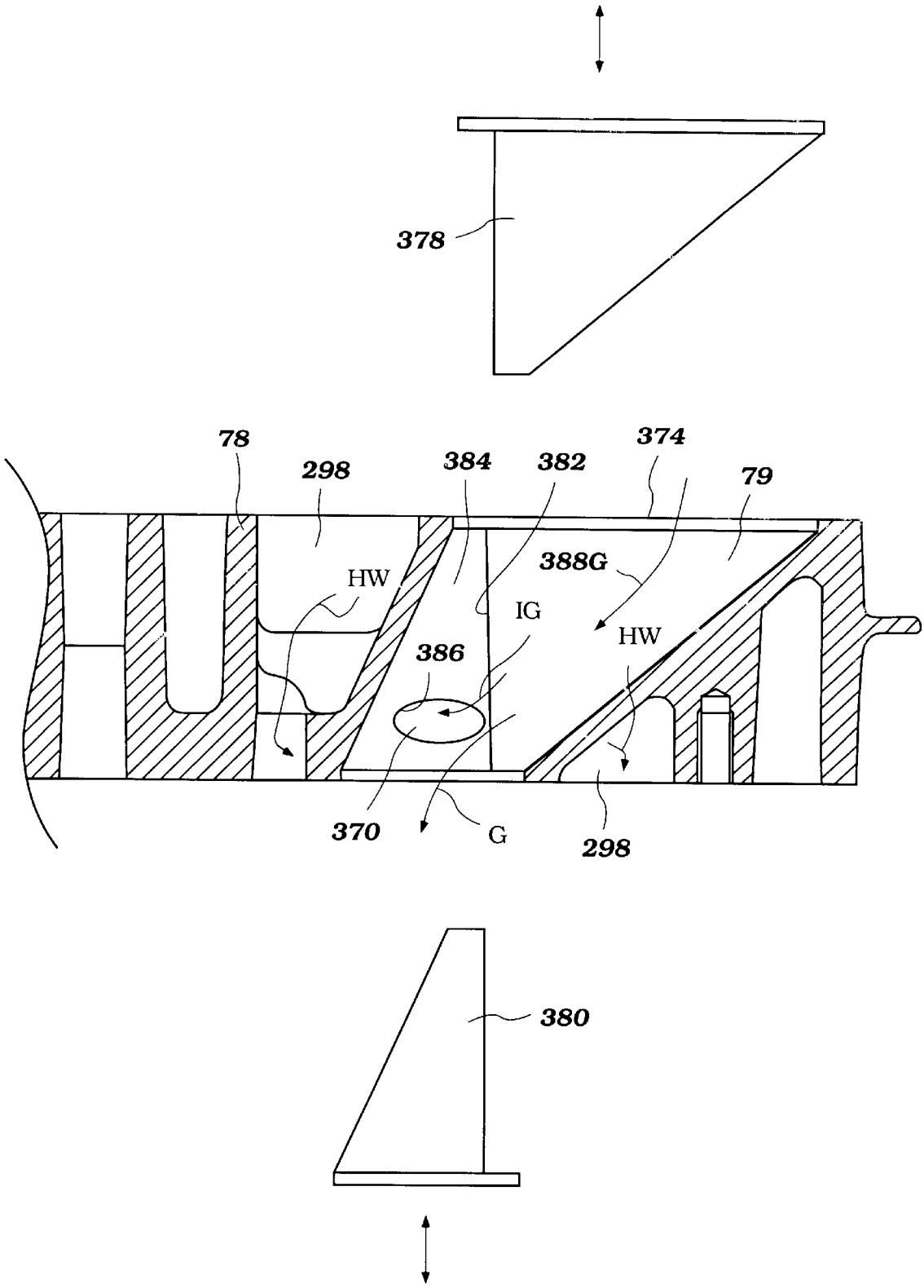
FIG. 20 is a partially sectional side view of the exhaust guide member to show a portion of an exhaust passage and a portion of a water jacket.

The exhaust passage 79, the second idle passage 372 and the idle expansion chamber 134 can be formed by a cast method. While the exhaust passage 79 is entirely formed within the exhaust guide member 78, the idle expansion chamber 134 is formed between the exhaust guide member 78 and the driveshaft housing 54. As best seen in FIG. 20, the exhaust passage 79 is configured as an inverted trapezoidal pillar. An inlet 374 of the exhaust passage 79 is positioned closer to a peripheral edge on the port side and an outlet 376 thereof is positioned closer to a center portion. Further, the inlet 374 is formed larger than the outlet 376. Because of this configuration, the exhaust passage 79 is cast using an upper mold 378 and a lower mold 380 both are drafted oppositely to one another. Both the upper and lower mold 378, 380 have trapezoidal pillar configuration. The upper mold 378, however, is larger than the lower mold 380. A step 382 thus is formed at a boundary where the molds 378, 380 abut on each other and a recessed area 384 is also formed downstream of the step 382 due to the respective draughts.

A cast method is conducted as follows. The molds 378, 380 are placed in a cast frame of the exhaust guide member 78 and then the member 78 is cast. The molds 378, 380 are drafted from the cast flame in opposed directions from each other. Because of the nature of the molds 378, 380, each root portion, which is positioned next to a longer end of the trapezoid configuration, makes the recessed area 384 deeper than the other end, i.e., shorter end. It should be noted that the trapezoidal pillar can replace the trapezoidal column if the exhaust system 100 allows.

The first idle passage 370 is drilled after casting the exhaust guide member 78. The first idle passage 370 communicates with the exhaust passage 79 at the recessed area 384. In other words, the first idle passage 370 is branched off from the exhaust passage 79 at a port 386. The port 386 is positioned closer to the driveshaft housing 54 than the engine 58. As best seen in FIG. 18, the exhaust gases flow in a direction as indicated by the arrow 388G in the exhaust passage 79. The first idle passage 370 makes an acute angle with the direction of the gas flow. Because of opening at the recessed area 284 and of making the acute angle, the exhaust gases hardly enter the first idle passage 370 under normal conditions such that the propeller 144 rotates in a relatively high speed. That is, the entire exhaust gases can flow through the exhaust passage 79 toward the exhaust pipe 132 under the conditions and no factor exists to pressurize the exhaust gases to the first idle passage 370.

The arrangement thus is advantageous because the first idle passage 370, particularly, the connecting portion to the exhaust passage 79 rarely allows adhesion of deposits containing carbons, lead and other components. The idle passage 370 or the connecting portion thus is not likely to be narrowed by such deposits. In addition, the operating noise is reduced under normal running conditions because there is no rush flow of exhaust gases through the idle passage 370. Further, because the recess 384 and the step 382 are formed during the cast process, no additional manufacturing process is necessary.

As best seen in FIG. 8, the first idle passage 370 communicates with the idle expansion chamber 134 through the second exhaust passage 372. The idle expansion chamber 134 is formed atop the driveshaft housing 54 at the rearmost position and next to the lubricant tank 114. Similar to the main expansion chamber 150, the idle expansion chamber 134 has a certain volume where idle exhaust gases expand so that exhaust noise is attenuated. The idle exhaust gases are discharged to the atmosphere through the idle discharge port 136.after releasing energy in the expansion chamber 134.

Figure 21:
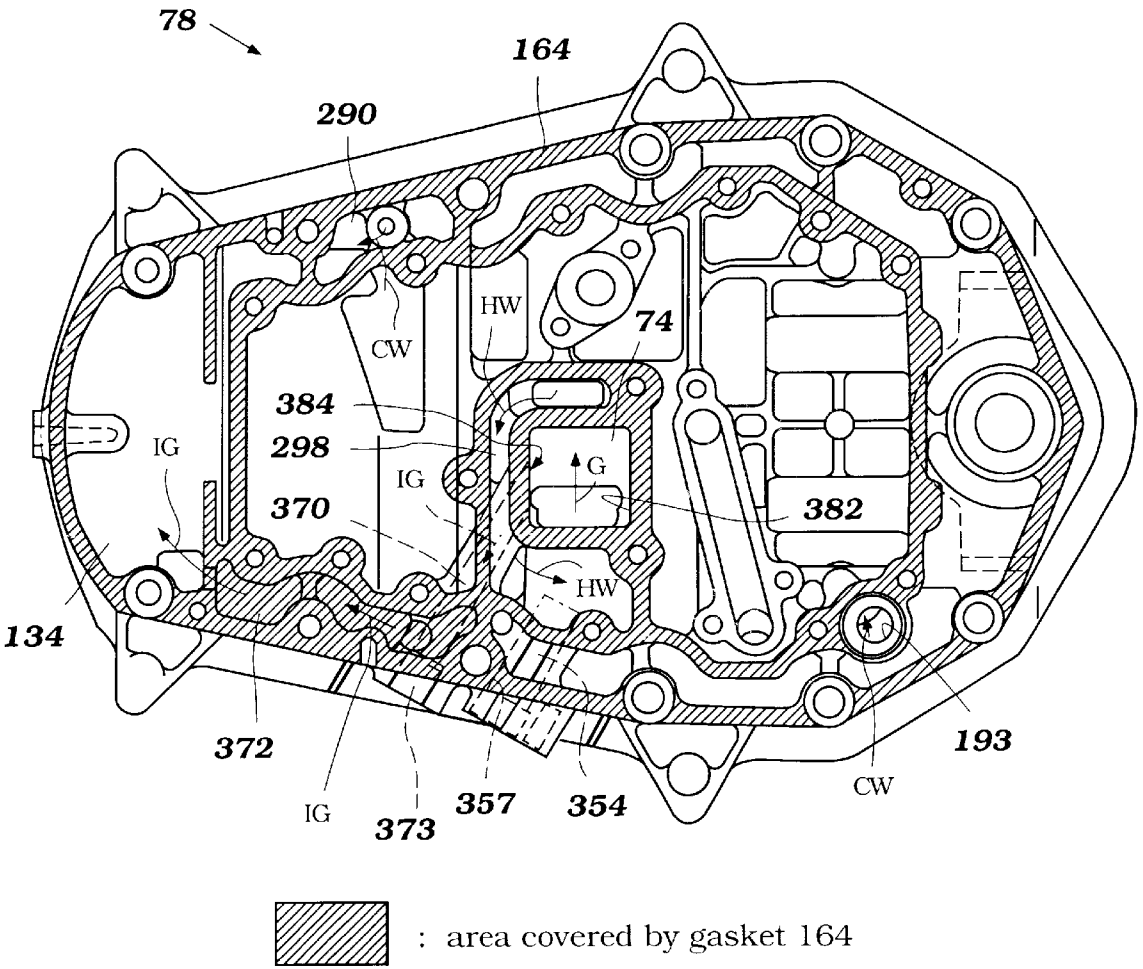
FIG. 21 is a bottom view of the exhaust guide member with a gasket. The area having hatching shows a configuration of the gasket in this view.

As best seen in FIG. 21, the gasket 164 completely covers the lower end of the second idle passage 372 to isolate the passage 372 from the water in the water pool 202 of the driveshaft housing 54, specifically, the outer pool 226. This is advantageous because the idle exhaust gases passing through the idle passage 372 do not meet the water and hence sulfuric acid corrosion does not occur around the driveshaft housing 54 and the exhaust guide member 78. Because of being formed only by the gasket 164, the isolation structure is quite simple and less expensive.

In the illustrated embodiment, both the upper flange 166 and the lower flange 260 of the exhaust pipe 132 are insulated from the support members by the gasket 170, the collars 176 and the washers 178 coated with insulation material and also the seal member 262, which preferably made of insulation material. Additionally, the anodes 246, 348, 350, 354 are affixed to the support members and/or members disposed around the exhaust pipe 132. The exhaust pipe 132, even though made of stainless steel, thus can be well protected from electrical corrosion. Any leakage of exhaust gases, lubricant oil or cooling water can occur in this arrangement.

Of course, the foregoing description is that of a preferred construction having certain features, aspects and advantages in accordance with the present invention. Various changes and modifications may be made to the above-described arrangements without departing from the spirit and scope of the invention, as defined by the appended claims.

What is claimed is:

1. An outboard motor comprising a power head including an internal combustion engine, a housing unit depending from the power head, an exhaust conduit arranged to discharge exhaust gases from the engine, at least a portion of the exhaust conduit extending through the housing unit, a cooling system arranged to cool at least the portion of the exhaust conduit with coolant, the cooling system including an inner coolant pool immersing the portion of the exhaust conduit in the coolant, and an outer coolant pool surrounding the inner coolant pool, the cooling system supplying the coolant to the inner and outer pools, the coolant supplied to the outer pool being cooler than the coolant supplied to the inner pool.

2. An outboard motor comprising a power head including an internal combustion engine, a housing unit depending from the power head, an exhaust conduit arranged to discharge exhaust gases from the engine, at least a portion of the exhaust conduit extending through the housing unit, a cooling system arranged to cool at least the portion of the exhaust conduit with coolant, the cooling system including an inner coolant pool surrounding the portion of the exhaust conduit, and an outer coolant pool surrounding the inner coolant pool, the cooling system supplying the coolant to the inner and outer pools, the coolant supplied to the outer pool being cooler than the coolant supplied to the inner pool, the housing unit having a partition separating the inner and outer pools from each other, the partition defining a drain through which the inner and outer pools communicate with one another, and a bracket assembly supporting the housing unit for pivotal movement about a tilt axis extending generally horizontally, wherein the drain is formed at a location such that the drain is generally positioned at a bottom of the partition when the housing unit is lifted about the tilt axis.

3. An outboard motor comprising a power head including an internal combustion engine, a housing unit depending from the power head, an exhaust conduit arranged to discharge exhaust gases from the engine, at least a portion of the exhaust conduit extending through the housing unit, a cooling system arranged to cool at least the portion of the exhaust conduit with coolant, the cooling system including an inner coolant pool surrounding the portion of the exhaust conduit, and an outer coolant pool surrounding the inner coolant pool, the cooling system supplying the coolant to the inner and outer pools, the coolant supplied to the outer pool being cooler than the coolant supplied to the inner pool, the housing unit having a partition separating the inner and outer pools from each other, the partition defining a first drain through which the inner and outer pools communicate with one another, the housing unit having an internal wall defining the outer pool, and the internal wall defining a second drain through which the outer pool communicates with a space surrounding the outer pool.

4. The outboard motor as set forth in claim 3 additionally comprising a bracket assembly supporting the housing unit for pivotal movement about a tilt axis extending generally horizontally, wherein the first and second drains are formed at a location such that the first and second drains are generally positioned at a bottom of the partition and at a bottom of the internal wall, respectively, when the housing unit is lifted about the tilt axis.

5. An outboard motor comprising a power head including an internal combustion engine, a housing unit depending from the power head, an exhaust conduit arranged to discharge exhaust gases from the engine, at least a portion of the exhaust conduit extending through the housing unit, a cooling system arranged to cool at least the portion of the exhaust conduit with coolant, the cooling system including an inner coolant pool surrounding the portion of the exhaust conduit, and an outer coolant pool surrounding the inner coolant pool, the cooling system supplying the coolant to the inner and outer pools, the coolant supplied to the outer-pool being cooler than the coolant supplied to the inner pool, the inner pool having a first spillway, and the outer pool having a second spillway that is positioned higher than the first spillway.

6. The outboard motor as set forth in claim 5, wherein the cooling system is further arranged to cool the engine by the coolant, the engine defines a coolant passage through which the coolant runs, and the cooling system supplies a portion of the coolant that has run through the coolant passage to the inner pool.

7. The outboard motor as set forth in claim 6, wherein the cooling system supplies a portion of the coolant that has not run through the coolant passage to the outer pool.

8. An outboard motor comprising a power head including an internal combustion engine, a housing unit depending from the power head, an exhaust conduit arranged to discharge exhaust gases from the engine, at least a portion of the exhaust conduit extending through the housing unit, a cooling system arranged to cool at least the portion of the exhaust conduit with coolant, the cooling system including an inner coolant pool surrounding the portion of the exhaust conduit, and an outer coolant pool surrounding the inner coolant pool, the cooling system supplying the coolant to the inner and outer pools, the coolant supplied to the outer pool being cooler than the coolant supplied to the inner pool, the housing unit having an internal wall defining the outer pool, and the internal wall having a drain through which the outer pool communicates with a space surrounding the outer pool.

9. The outboard motor as set forth in claim 8 additionally comprising a bracket assembly supporting the housing unit for pivotal movement about a tilt axis extending generally horizontally, wherein the drain is formed at a location such that the drain is positioned at a bottom of the internal wall when the housing unit is lifted about the tilt axis.

10. An outboard motor comprising a power head including an internal combustion engine, a housing unit depending from the power head, an exhaust conduit arranged to discharge exhaust gases from the engine, at least a portion of the exhaust conduit extending through the housing unit, a cooling system arranged to cool at least the portion of the exhaust conduit with coolant, the cooling system including an inner coolant pool surrounding the portion of the exhaust conduit, and an outer coolant pool surrounding the inner coolant pool, the cooling system supplying the coolant to the inner and outer pools, the coolant supplied to the outer pool being cooler than the coolant supplied to the inner pool, the cooling system including a coolant pathway out of the outer pool, the inner pool communicating with the coolant pathway through the outer pool.

11. The outboard motor as set forth in claim 10, wherein the housing unit has an internal wall defining the outer pool, and the coolant pathway is defined between an inner surface of the housing unit and an outer surface of the internal wall.

12. The outboard motor as set forth in claim 11, wherein the housing unit additionally has a coolant discharge conduit communicating with the inner pool and extending into the coolant pathway.

13. The outboard motor as set forth in claim 12, wherein the coolant discharge conduit is spaced apart from the inner surface of the housing unit.

14. The outboard motor as set forth in claim 12, wherein the coolant discharge conduit has an end portion from which the coolant is discharged, and the end portion is cut away so as to face the internal wall.

15. The outboard motor as set forth in claim 12, wherein the coolant discharge conduit is formed separately from the housing unit and has a positioning portion by which the coolant discharge conduit is positioned relative to the housing unit.

16. The outboard motor as set forth in claim 12, wherein the coolant discharge conduit has a pair of flat surfaces extending generally in parallel to the inner surface of the housing unit.

17. An outboard motor comprising a power head including an internal combustion engine, a housing unit depending from the power head, an exhaust conduit arranged to discharge exhaust gases from the engine, at least a portion of the exhaust conduit extending through the housing unit, a cooling system arranged to cool at least the portion of the exhaust conduit with coolant, the cooling system including an inner coolant pool surrounding the portion of the exhaust conduit, and an outer coolant pool surrounding the inner coolant pool, the cooling system supplying the coolant to the inner and outer pools, the coolant supplied to the outer pool being cooler than the coolant supplied to the inner pool, the housing unit having an internal wall defining the outer pool and a partition separating the inner and outer pools from each other, the internal wall being unitarily formed with the housing unit, and the partition being separately formed with the housing unit.

18. The outboard motor as set forth in claim 17, wherein a portion of the partition is placed on the internal wall, and a seal member closes a space formed between the portion of the partition and the internal wall.

19. The outboard motor as set forth in claim 17, wherein the exhaust conduit extends through a portion of the partition, and a seal member closes a space formed between the exhaust conduit and the portion of the partition.

20. The outboard motor as set forth in claim 19, wherein the partition has a step portion, the exhaust conduit has a flange, and the seal member is interposed between the step portion and the flange.

21. The outboard motor as set forth in claim 20, wherein the partition is affixed to a member or a portion of the housing unit disposed above the partition by a thrust fastener so that the step portion thrusts up the seal member toward the flange.

22. The outboard motor as set forth in claim 21 additionally comprising a lubricant tank for the engine disposed in the housing unit above the partition, wherein the partition is affixed to the lubricant tank.

23. The outboard motor as set forth in claim 1, wherein the exhaust conduit extends at least toward a bottom end of the inner pool.

24. The outboard motor as set forth in claim 1, wherein the exhaust conduit extends beyond a bottom end of the inner pool.

25. The outboard motor as set forth in claim 1, wherein the cooling system is an open-loop system that draws cooling water from and returns cooling water to a body of water in which the outboard motor is operated.

26. An outboard motor comprising a power head including a four-cycle, internal combustion engine, a housing unit depending from the power head, a lubricant tank for the engine disposed in the housing unit, an exhaust conduit arranged to discharge exhaust gases from the engine, the exhaust conduit extending through the lubricant tank and at least a portion of the exhaust conduit extending lower than a bottom of the lubricant tank, and a cooling system arranged to cool at least the lubricant tank and the exhaust conduit with coolant, the cooling system including an inner coolant pool surrounding the portion of the exhaust conduit, and an outer coolant pool surrounding the inner coolant pool and the lubricant tank, and the cooling system supplying the coolant to the inner and outer pools, the inner coolant pool having a first spillway positioned below the lubricant tank and above a bottom of the exhaust conduit, the outer coolant pool having a second spillway positioned above the bottom of the lubricant tank.

27. The outboard motor as set forth in claim 26, wherein the cooling system is further arranged to cool the engine, the engine defines a coolant passage through which the coolant runs, and the cooling system supplies a portion of the coolant that has run through the coolant passage to the inner pool.

28. The outboard motor as set forth in claim 27, wherein the cooling system supplies a portion of the coolant that has not run through the coolant passage to the outer pool.

29. An outboard motor comprising a power head including an internal combustion engine, a housing unit depending from the power head, and an exhaust system arranged to discharge exhaust gases from the engine, the exhaust system including an exhaust pipe connected to the engine and an expansion chamber disposed downstream of the exhaust pipe, the exhaust pipe defining an upper portion existing next to the engine and a lower portion existing next to the expansion chamber, the housing unit including a first tubular section to define a first coolant pool immersing the lower portion of the exhaust pipe in coolant, the first tubular section having a portion defining a bottom of the first coolant pool, and the portion of the first tubular section being disposed in proximity to a top end of the expansion chamber, and a second tubular section to define a second coolant pool immersing the first tubular section in coolant.

30. The outboard motor as set forth in claim 29, wherein a seal member closes a space formed between the exhaust pipe and the portion of the tubular section.

31. The outboard motor as set forth in claim 30, wherein the portion of the tubular section has a step, the exhaust pipe has a flange, and the seal member is interposed between the step and the flange.

32. The outboard motor as set forth in claim 29, wherein the tubular section is formed with a piece that is separable from the housing unit.

33. An outboard motor comprising a power head including an internal combustion engine, a housing unit depending from the power head, and an exhaust system arranged to discharge exhaust gases from the engine, the exhaust system including an exhaust pipe connected to the engine and an expansion chamber disposed downstream of the exhaust pipe, the housing unit including a first tubular section to define a coolant pool surrounding a portion of the exhaust pipe, the first tubular section having a portion defining a bottom of the coolant pool, and the portion of the first tubular section being disposed in proximity to a top end of the expansion chamber, the housing unit additionally including a second tubular section to define a second coolant pool surrounding the first coolant pool, and coolant in the second coolant pool being cooler than coolant in the first coolant pool.

34. The outboard motor as set forth in claim 33, wherein the housing unit defines a discharge pathway through which the coolant is discharged, and a dividing wall which divides the discharge pathway from the exhaust system.

35. An outboard motor comprising a power head including an internal combustion engine, a housing unit depending from the power head, and an exhaust system arranged to discharge exhaust gases from the engine, the exhaust system including an exhaust conduit having an outlet arranged to open to a space within the housing unit, the housing unit including a first portion forming a first water pool surrounding at least a portion of the exhaust conduit, the housing unit additionally including a second portion forming a second water pool generally surrounding the first water pool, the housing unit defining a water discharge pathway through which the water in both of the first and second water pools is discharged, and the housing unit further defining a dividing wall separating the water discharge pathway from the space.

36. The outboard motor as set forth in claim 1, wherein the cooling system generally entirely cools the exhaust conduit, the cooling system additionally includes a coolant path defined along a second portion of the exhaust conduit which is positioned out of the inner pool, the coolant is supplied to the inner pool through the coolant path.

37. The outboard motor as set forth in claim 1, wherein the housing unit has a partition separating the inner and outer pools from each other, a bottom portion of the partition generally disposed in proximity to the exhaust conduit, and a seal member is interposed between the bottom portion of the partition and a step of the exhaust conduit.

38. The outboard motor as set forth in claim 35, wherein water in the second water pool flows into the first water pool.

39. The outboard motor as set forth in claim 38, wherein the first portion defines a water passage communicating with the water discharge pathway through the second portion, the first water pool is connected to the water discharge pathway through the water passage.

* * * * *